US009761925B2

(12) United States Patent
Sato et al.

(10) Patent No.: US 9,761,925 B2
(45) Date of Patent: Sep. 12, 2017

(54) MULTI-BAND ANTENNA AND TERMINAL DEVICE

(71) Applicant: SONY MOBILE COMMUNICATIONS AB, Lund (SE)

(72) Inventors: Takahiro Sato, Tokyo (JP); Tomihiro Omuro, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 574 days.

(21) Appl. No.: 13/765,319

(22) Filed: Feb. 12, 2013

(65) Prior Publication Data

US 2014/0225781 A1 Aug. 14, 2014

(51) Int. Cl.
*H01Q 1/24* (2006.01)
*H01Q 9/42* (2006.01)
*H01Q 5/371* (2015.01)

(52) U.S. Cl.
CPC ..... *H01Q 1/243* (2013.01); *H01Q 5/371* (2015.01); *H01Q 9/42* (2013.01)

(58) Field of Classification Search
CPC ..... H01Q 1/243; H01Q 5/371; H01Q 9/42
USPC ..... 343/702, 828
See application file for complete search history.

(56) References Cited

U.S. PATENT DOCUMENTS 5,877,727 A * 3/1999 Saitou ..... H01Q 1/1278 343/704
7,990,321 B2 8/2011 Shih
8,743,010 B2 * 6/2014 Yanagi et al. ..... 343/845
8,890,753 B1 * 11/2014 Lee ..... 343/702
2011/0140978 A1 6/2011 Maruyama

* cited by examiner

*Primary Examiner* — Hoang Nguyen
(74) *Attorney, Agent, or Firm* — Oblon, McClelland, Maier & Neustadt, L.L.P.

(57) ABSTRACT

An antenna that includes a first element extending from a connection point, and has a curvature such that a first tip end of the first element extends in a direction toward the connection point. A second element is connected to the connection point, and has a second tip end that extends in a direction away from the connection point, the second tip being disposed within an outer periphery of the first element. A distance between a portion of the first element that is parallel to the second element is greater than $\lambda_{gx}/100$, where $\lambda_{gx}$ represents an effective wavelength of a first anti-resonance frequency.

21 Claims, 46 Drawing Sheets

FIG. 19

| Element | Condition | Conducted power [dBm] | TRP [dBm] | 1g SAR [W/kg] |
|---|---|---|---|---|
| Present | Body 10mm | 23.0 | 19.2 | 1.53 |
| | Body 15mm | 23.0 | 19.2 | 0.65 |
| Absent | Body 10mm | 23.0 | 19.2 | 2.45 |
| | Body 15mm | 23.0 | 19.2 | 1.11 |

MULTI-BAND ANTENNA AND TERMINAL DEVICE

BACKGROUND

Technical Field

The present disclosure relates to an antenna device and a corresponding terminal for the antenna device.

Description of Related Art

Terminal devices, such as cellular phones, smart phones, and tablet devices, typically include an antenna apparatus with which to transmit and receive voice and/or data signals. The frequency bandwidth utilization is increasing in these terminal devices. In order to cope with the increase in bandwidth, there exists a method of providing multiple antennas to accommodate a wider frequency spectrum. Additionally, there exists a method of carrying out bandwidth increases utilizing a single antenna.

When a single antenna is used, it is preferable that any increase in bandwidth capacity does not unnecessarily increase the antenna size. Additionally, when carrying out a bandwidth increase using a single antenna, it is preferable not only to ensure favorable performance of each frequency band, but also to optimize Specific Absorption Rate (SAR) of each band to counter effects of SAR that are detrimental to antenna and/or terminal device performance. Previously, conventional cellular phone design was mainly concerned with reducing SAR of a user's head during a telephone call. However, in the case of a smart phone, a design should consider not only reducing SAR of the user's head during telephone calls, but also SAR of the user's body at the time of a data transmission (e.g., Internet transmissions, streaming, etc.), which are often being performed while the smart phone is stored close to the body (e.g., in the pocket of a coat).

U.S. Pat. No. 7,990,321 describes an exemplary multi-band antenna. The antenna as described in this literature is made to support multiple frequency bands (e.g., Global System for Mobile Communications (GSM), Global Positioning System (GPS), Digital Cellular Service (DCS), Personal Communication Service (PCS)) using one antenna feeding portion for passing electromagnetic signals in a plurality of frequency bands. Since a coupled grounding portion is provided in the case of the antenna, it is a premise of the literature to arrange and use the multi-band antenna on a circuit board substrate. For this reason, the countermeasure against SAR is left to the circuit side of a terminal device. This arrangement is problematic because any adjustments needed in the circuit board components involve undesirable increases in manufacturing and materials costs, as well as new printed circuit board (PCB) layout design labor costs.

SUMMARY

Among other things, the present disclosure describes an antenna and corresponding terminal device for providing multi-band frequency response, while countering against the effects of SAR.

An antenna of the present disclosure may include a first element extending from a connection point. The first element may have a curvature such that a first tip end of the first element extends in a direction toward the connection point. The antenna may include a second element that is connected to the connection point. The second element may have a second tip end that extends in a direction away from the connection point. The second tip may be disposed within an outer periphery of the first element. A distance between a portion of the first element that is parallel to the second element may be greater than $\lambda_{g\alpha}/100$, where $\lambda_{g\alpha}$ represents an effective wavelength of a first anti-resonance frequency.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein:

FIG. 19 shows exemplary SAR measurements in tabular form for the case in which an exemplary antenna does not include a second element, as well as the case in which the second element is included;

DETAILED DESCRIPTION

Figure 1:
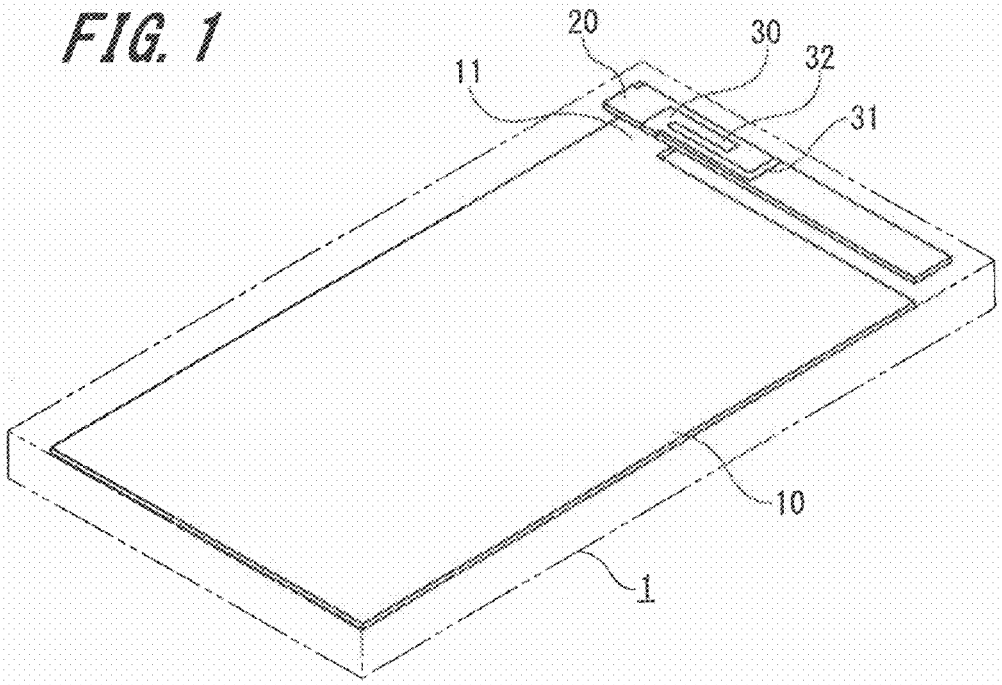
FIG. 1 shows an exemplary terminal device and antenna arrangement.

Referring now to the drawings, wherein like reference numerals designate identical or corresponding parts throughout the several views.

FIG. 1 illustrates an example of a terminal device 1, which shows one aspect of an exemplary antenna arrangement. Terminal device 1 includes a circuit board 10, which may include communication processing circuitry described in later paragraphs. The circuit board 10 includes an edge part corresponding to an electric power feeding circuit 11 for an antenna 30. The antenna 30 includes a first element 31 and a second element 32, which are formed on an elongated circuit board substrate 20. Elements included in the antenna 30 are electrically connected via conductors, such as copper. The substrate 20 may be connected to the circuit board 10 in such a manner that it "floats" on the substrate 20 surface. The height at which the substrate 20 floats from the circuit board 10 corresponds to the length of a third element 33, which will be described in further detail in later paragraphs. As a non-limiting example of the multi-band characteristics associated with the antenna 30, a low frequency band of the antenna 30 may perform transmission and reception at 900 MHz, and a high frequency band of the antenna 30 may perform transmission and reception at 2 GHz. However, it should be appreciated that the present disclosure may easily be adapted such that other frequency bands are used.

Figure 2:
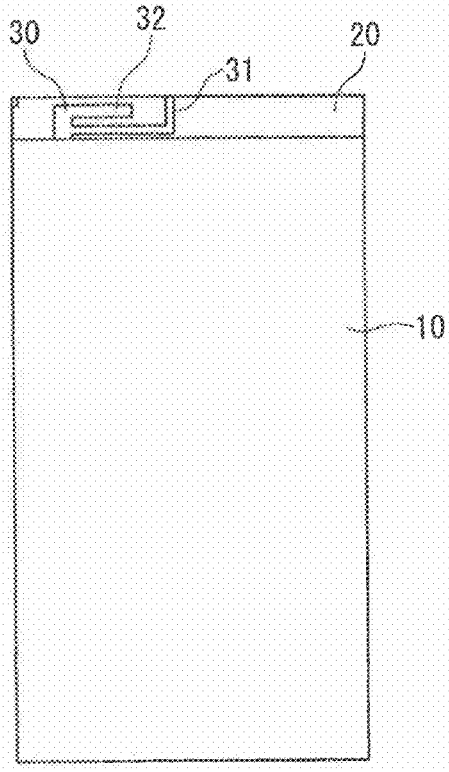
FIG. 2 illustrates a top-view perspective of the arrangement in FIG. 1.
Figure 3:
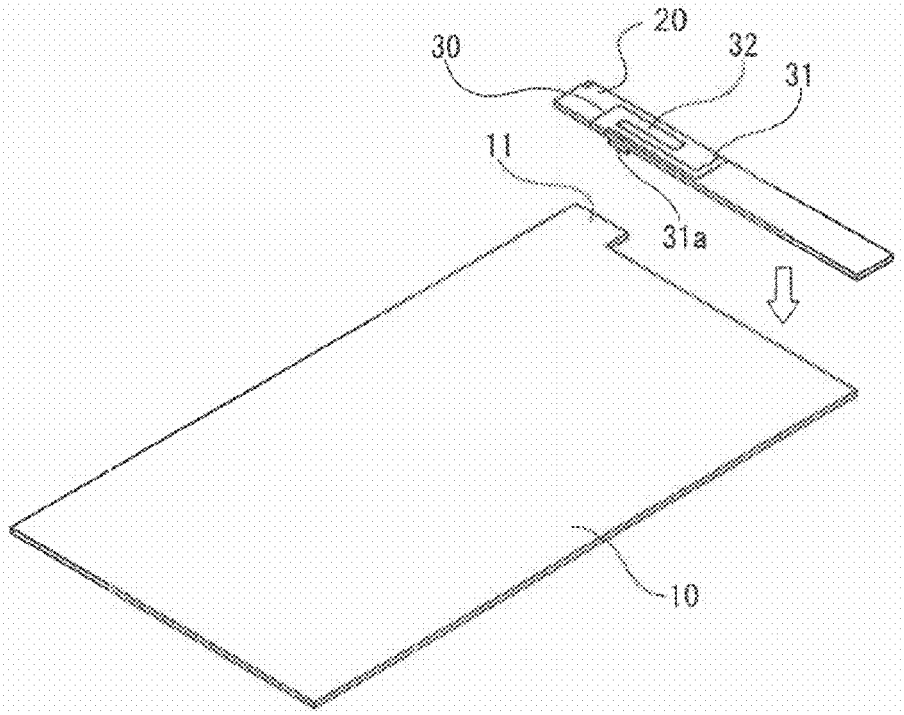
FIG. 3 illustrates a disassembled view of the FIG. 2 elements.

For illustration purposes, FIG. 2 illustrates a top-view perspective of the terminal device 1, and FIG. 3 illustrates a disassembled view of the circuit board 10 and the substrate 20.

Figure 4:
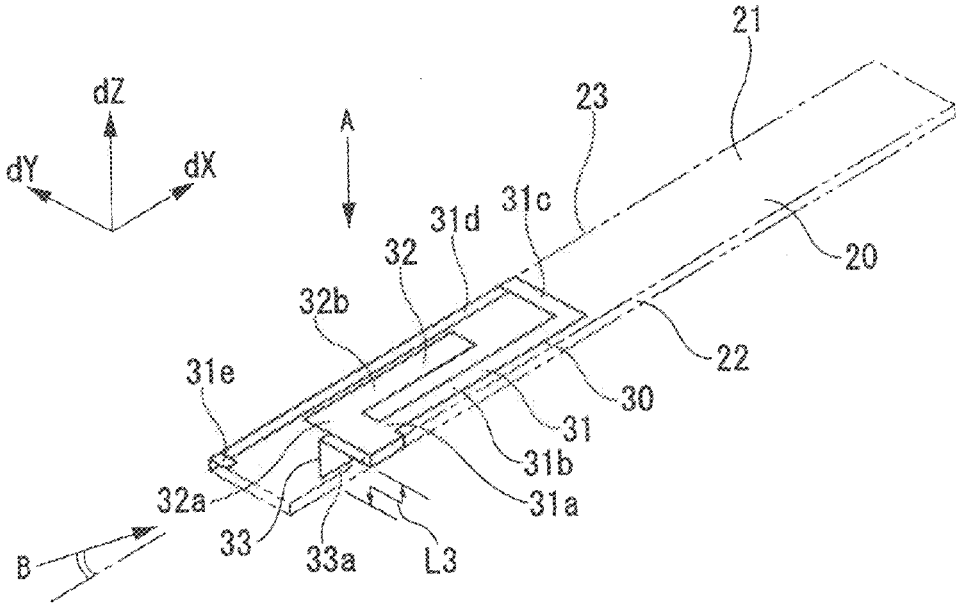
FIG. 4 illustrates a perspective view showing an exemplary antenna.

Next, FIG. 4 illustrates a perspective view showing detail of the antenna 30.

Referring to FIG. 4, the three axes dX, dY, and dZ illustrate an orientation of the various elements in the figure. The exemplary antenna 30 may include the first element 31, the second element 32, and the third element 33. The first element 31 may have an elongated structure extending along a first axis (e.g., the dX axis) while bending from a connection point 31*a* to connect with the second element 32 such that the structure of the second element 32 may be enclosed within the first element 31. A connection point 33*a* of the end of the third element 33 of the antenna 30 may be connected to the electric power feeding circuit 11 of the circuit board 10.

The first element 31 may comprise multiple linear electrically conductive sub-elements, including components 31*b*, 31*c*, 31*d*, and 31*e*. Each component 31*b*, 31*c*, 31*d*, and 31*e* are shown in FIG. 4 being connected at right angles; however, other arrangements may easily be used, and this configuration is not limiting. The component 31*b* includes the connection point 31*a* and is extended along the longitudinal direction (dX) on a surface 21 of the antenna substrate 20. The component 31*c* is connected to the component 31*b*, and extends in the width direction (dY) on the surface 21 of the antenna substrate 20. The component 31*c* and the connected component 31*d* are arranged on a side surface 23 of the antenna substrate 20. The component 31*d* and the connected component 31*e* are arranged on the surface 21 of the antenna substrate 20.

The second element 32 may be L-shaped, where components 32*a* and 32*b* are connected at a right angle. As mentioned above and illustrated in FIG. 4, the second element 32 may be arranged such that the components of the first element 31 are positioned around the second element 32. A tip of the component 31*e* is separated from a tip of the component 32*b*.

The third element 33 may be connected to the second element 32. The third element 33 may be a shape that extends along a side surface 22 of the antenna substrate 20 from a lower surface of the antenna 30. An upright tip of the third element 33 corresponds to the connection point 33*a*, which connects with the electric power feeding circuit 11. Length L3 shown in FIG. 4 shows the length of the third element 33. The definition of length L3 of the third element 33 is discussed in further detail in later paragraphs.

Figure 5:
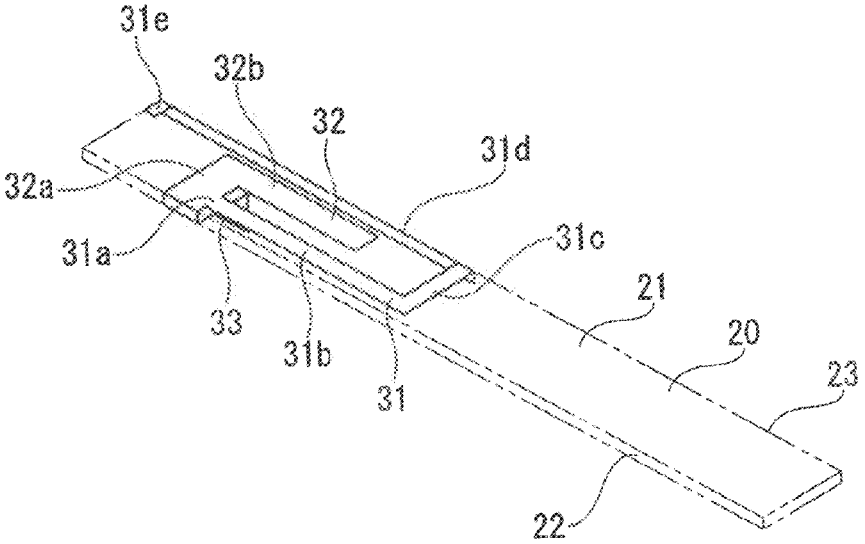
FIG. 5 shows the exemplary antenna of FIG. 4 from an alternate perspective.

For illustration purposes, FIG. 5 shows the exemplary antenna 30 from an alternate perspective.

Figure 6:
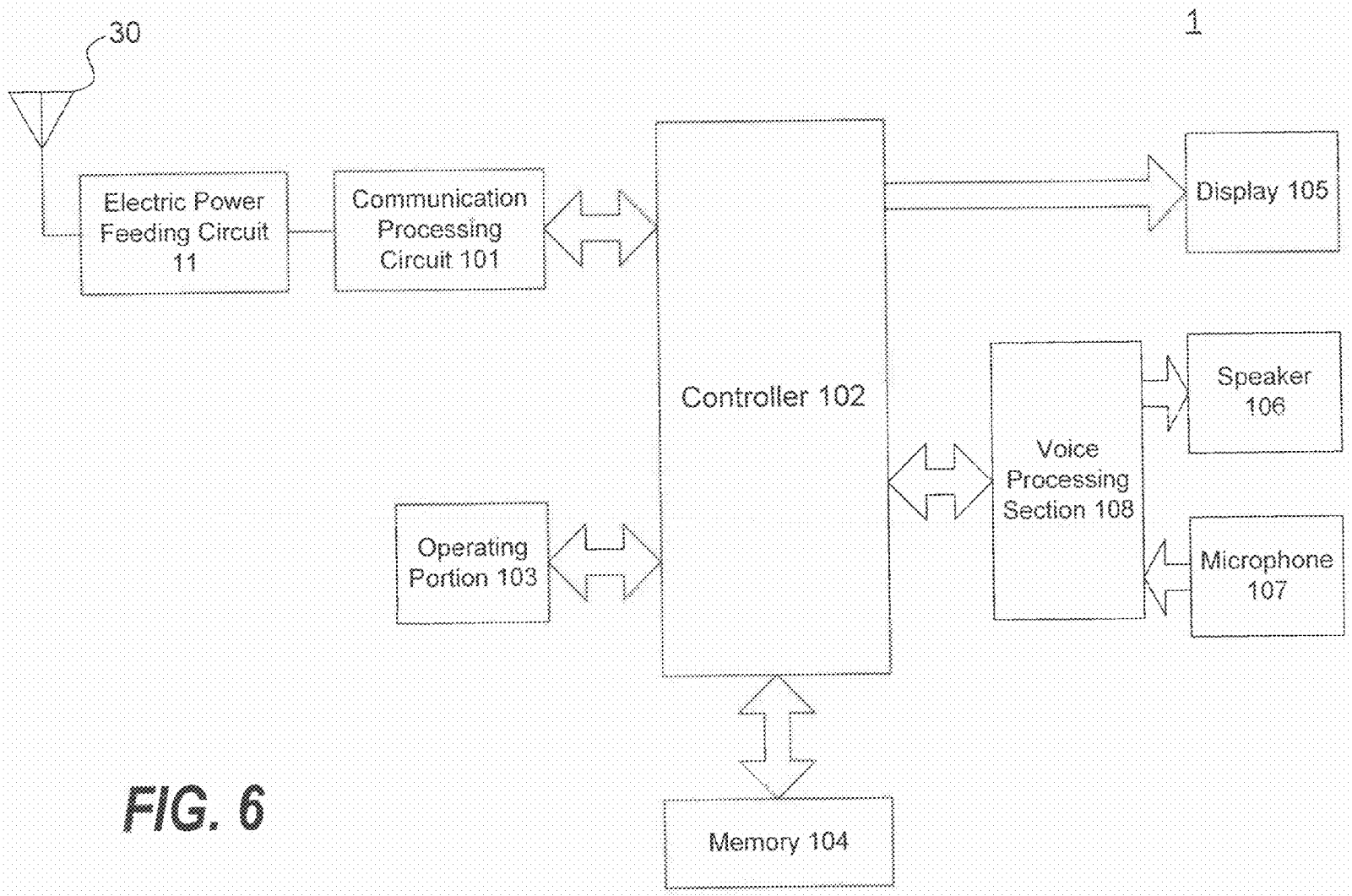
FIG. 6 illustrates a block diagram of an exemplary terminal device.

Next, FIG. 6 illustrates a block diagram of the exemplary terminal device 1. Terminal device 1 may, e.g., be a mobile phone, a smart phone, a personal digital assistant (PDA), a tablet computer, or the like.

Referring to FIG. 6, the terminal device 1 may be equipped with the antenna 30, which may connect to a controller 102 via the electric power feeding circuit 11 and a communication processing circuit 101. The terminal device 1 may also include an operating portion 103, a memory 104, a display 105, a speaker 106, a microphone 107, and a voice processing section 108. The communication processing circuit 101 processes voice and data signals transmitted to/from the antenna 30. The processing of the communication processing circuit 101 may include modulating and demodulating signals supplied to/from the antenna 30. As a non-limiting example, the communication processing circuit 101 may utilize 900 MHz and 2 GHz frequency bands in the processing, and may transmit/receive signals via radio and/or wireless paths to other devices and/or base stations. For example, the terminal device 1 may communicates according to the Long Term Evolution (LTE) specification.

The controller 102 is comprised, e.g., of a Central Processing Unit (CPU), which may include one or more processors that are programmed to execute instructions stored in the memory 104 when performing the various features of the terminal device 1.

The operating portion 103 may include various interface elements for performing input on the terminal device 1. For example, the operating portion 103 may interface with external buttons and/or a touch screen, where detected inputs on these interface elements may generate an operation signal, which the operating portion 103 and/or the controller 102 may utilize for further processing.

The memory 104 may consist of a Read Only Memory (ROM), a Random Access Memory (RAM), or combination thereof. For example, data that needs to be stored/memorized for later use may be stored in ROM, while RAM may be used as working memory, e.g., in the case where the controller 102 performs control processing.

The display 105 may be a liquid crystal panel, an organic Electro Luminescence (EL) panel, or the like. The display 105 may perform display features regarding, e.g., transmission or receipt of voice and data signals. For example, the display 105 may display information regarding a telephone call, a Web page, a text message, images, or the like.

The speaker 106 and the microphone 107 are connected to the voice processing section 108. The speech-processing part 108 may perform a modulation process to audio data received by the communication processing circuit 101, and supply it to the speaker 106. Moreover, the speech-processing part 108 may modulate voice signals acquired with the microphone 107 to generate audio data for transmission via the communication processing circuit 101.

Figure 7:
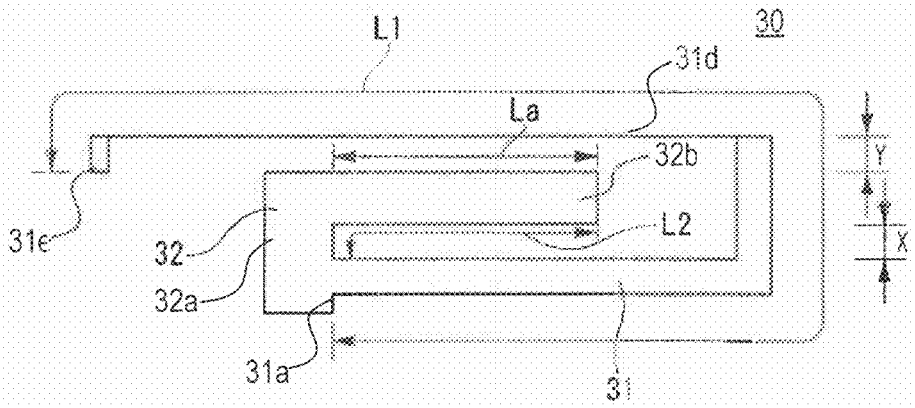
FIG. 7 illustrates dimensional features of an exemplary antenna.

Next, FIG. 7 illustrates exemplary dimensional features of the antenna 30. It should be appreciated that the features discussed with regard to FIG. 7 are merely provided for illustration purposes; however these features are not limiting, and other dimensional features may easily be incorporated in a multi-band antenna of the present disclosure.

Referring to FIG. 7, the length from the connection point 31*a* of the first element 31 to the component 31*e* at a tip of the first element 31 is set to L1. The length of the second element 32 is set to L2. The length L2 of the second element 32 corresponds to the length from where the connection point 31*a* meets the element 32*a*, to a tip of the component 32*b*. The length of the component 32*b* of the second element 32 is set to La. The space between the component 32*b* of the second element 32 and the component 31*b* of the first element 31 is set to X. The space between the component 32*b* of the second element 32 and the component 31*d* of the first element 31 is set to Y.

Spacing length Y is defined as follows:

$$Y>\lambda_{gx}/100$$

Here, $\lambda_{gx}$ is the effective wavelength of the first anti-resonance frequency $f_x$, and Y is defined in meters.

Specific Example of Spacing Length Y:

First anti-resonance frequency $f_x$=1.4 GHz $$\lambda_{gx}=C/f_x*1/\sqrt{\in r},$$

where C is the speed of light in a vacuum, and $\in$r is a dielectric constant of a medium. Although the elements 31 and 32 are arranged on the medium of a dielectric material, since a single surface of the medium is open, there are few wavelength shortening effects. Therefore, based on a simulator result, $\in$r is set to a value at which $1/\sqrt{\in r}=0.85$, which yields:

$$\lambda_{gx}=214.3*0.85\approx 0.18 \text{ m}$$

$$\lambda_{gx}/100=0.0018 \text{ m}=1.8 \text{ mm}$$

Therefore, with first anti-resonance frequency $f_x$=1.4 GHz, the resultant spacing length Y becomes Y>1.8 mm using the above-defined inequality.

Length L1 of the first element 31 should satisfy the conditions of following inequality:

$$5*(2n+1)*\lambda_{g1}/8<L1<7*(2n+1)*\lambda_{g1}/8,$$

where $\lambda_{g1}$ is the effective wavelength (in meters) corresponding to a minimum frequency $f_1$ of a countermeasure frequency band, and n is a positive integer or 0.

Length L2 of the second element 32 should satisfy the conditions of following inequality:

$$L2<=(2n+1)*\lambda_{g1}/4$$

An adjustment of the impedance of the minimum frequency simplifies the derivation of length L3 of the third element 33. Specifically, length L3 is made to satisfy:

Voltage Standing Wave Ratio (VSWR)<7.

The point to which an adjustment of the impedance is preferred is the point at which the first element 31 is connected. If the second element 32 is short enough with respect to the wavelength of the low frequency band (e.g., 900 MHz), the antenna 30 including elements 31, 32, and 33 that satisfies such conditions may exhibit the same behavior as the case of only a single element.

It should be noted that although the definition of the spacing length X is not shown, the length may be made to correspond to spacing length Y.

Figure 8A:
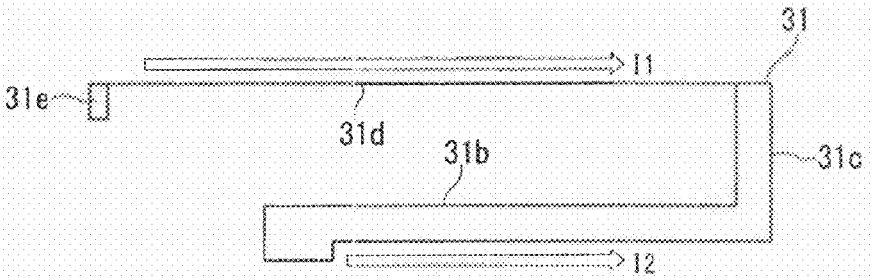
FIGS. 8A and 8B respectively illustrate current phasors and magnetic field vectors of an exemplary antenna.
Figure 8B:
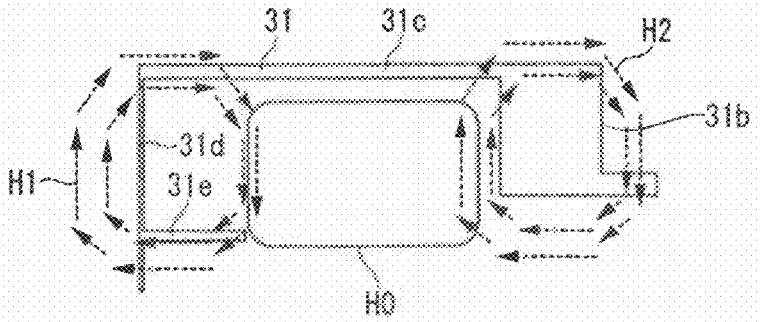
Figure 9A:
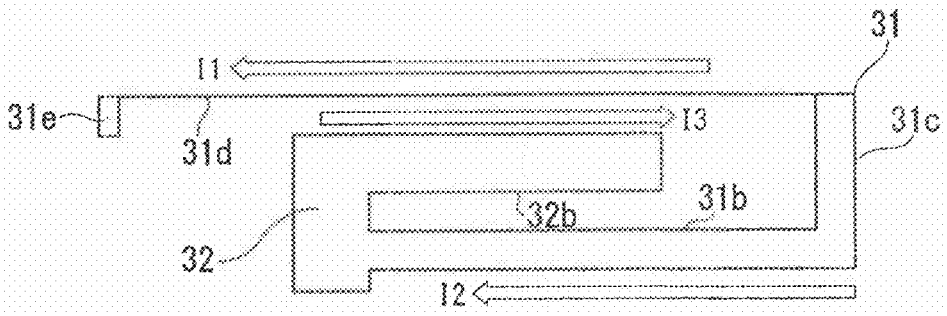
FIGS. 9A and 9B respectively illustrate current phasors and magnetic field vectors of another exemplary antenna.
Figure 9B:
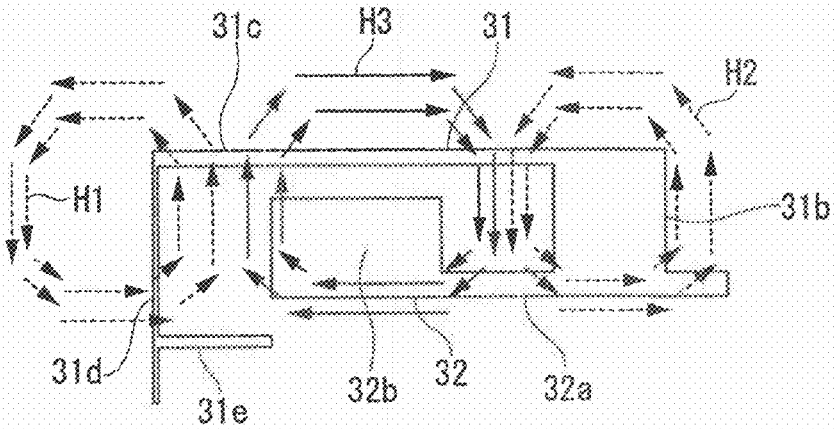

In order to demonstrate the high performance characteristics of an antenna according to the present disclosure, such as antenna 30, features of an antenna without the second element 32 are first shown in FIGS. 8A and 8B, and features of the antenna 30 with the second element 32 included are shown in FIGS. 9A and 9B.

First, FIG. 8A shows current phasors I1 and I2 of an antenna comprising only the first element 31. The perspective of FIG. 8A corresponds to the direction of arrow A in FIG. 4, which also shows the first element 31. The current phasor I1 is generated by the component 31*d*. The current phasor I2 is generated by the component 31*b*. Current phasors I1 and I2 are the same direction.

FIG. 8B shows magnetic field vectors H1 and H2 of the antenna comprising only the first element 31 (i.e., resultant magnetic field vectors from current vectors I1 and I2 of FIG. 8A). The perspective of FIG. 8B corresponds to the direction of arrow B of FIG. 4, which also shows the first element 31. The direction of arrow B is a direction which is slightly inclined with respect to the surface 21 of the antenna substrate 20. As shown in FIG. 8B, partial H0 is mutually negated due to the direction of generated magnetic field vectors H1 and H2.

Next, FIG. 9A shows current phasors I1, I2, and I3 of the antenna 30, which includes both first element 31 and the second element 32. FIG. 9A shows the antenna 30 from a perspective corresponding to arrow A of FIG. 4. The current phasor I1 is generated by the component 31*d* of the first element 31. The current phasor I2 is generated by the component 31*b* of the first element 31. The current phasor I3 is generated by the component 32*b* of the second element 32. Current phasors I1 and I2 are in the opposite direction of the current phasor I3.

FIG. 9B shows magnetic field vectors H1, H2, and H3 of the antenna (i.e., resultant magnetic field vectors from current vectors I1, I2, and I3 of FIG. 9A). FIG. 9B shows the antenna 30 from a perspective corresponding to arrow B of FIG. 4. As evident in FIG. 9B, magnetic field vectors H1 and H3 overlap between the component 31*d* and the component 32*b*, and the magnetic field vector H2 and the magnetic field vector H3 overlap between the component 32*b* and the component 31*b*. Due to the direction of the overlapping vectors, the overlapping magnetic field vectors may be added. As a result of this overlap, the magnitude of electric current amount of current phasors I1, I2, I3 becomes large. In particular, the current phasor I3 corresponding to the overlapped magnetic field vector H3 is predominant in this example. Additionally, the first element 31 and the second element 32 are electromagnetically coupled, and the extent of the coupling is controlled by spacing lengths X and Y (FIG. 7), and the magnitude of the electric current I3 (FIG. 9A) of the second element 32. The resonant frequency in this case occurs when the electric current amount 13 becomes the highest, and when length L2 of the second element 32 is in the λg/4 vicinity.

The direction of each magnetic field vector can also be changed by adjusting the electric current I3, spacing lengths X and Y, and the length L2 of the second element 32. In this case, magnetic field directivity begins to change with a frequency in the λg/4 vicinity. For this reason, appropriate element sizing should be chosen while confirming SAR of the antenna 30. Spacing Y may especially experience a first anti-resonance frequency (e.g., 1400-1700 MHz), and since the wavelength shortening effect can be present, it is possible to show an element long. Therefore, what is necessary is to decide on the conditions satisfied while also confirming the characteristic that the wavelength shortening effect is acquired.

Figure 10A:
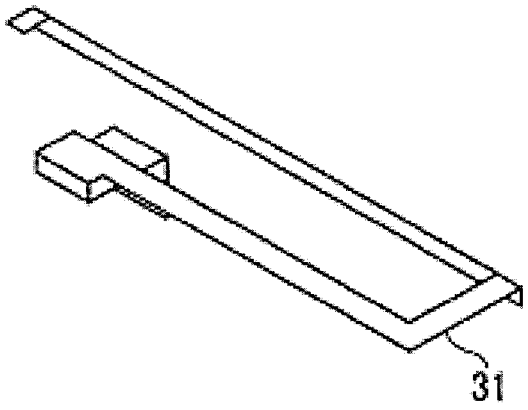
FIGS. 10A-D illustrate SAR simulations for an exemplary antenna.
Figure 10B:
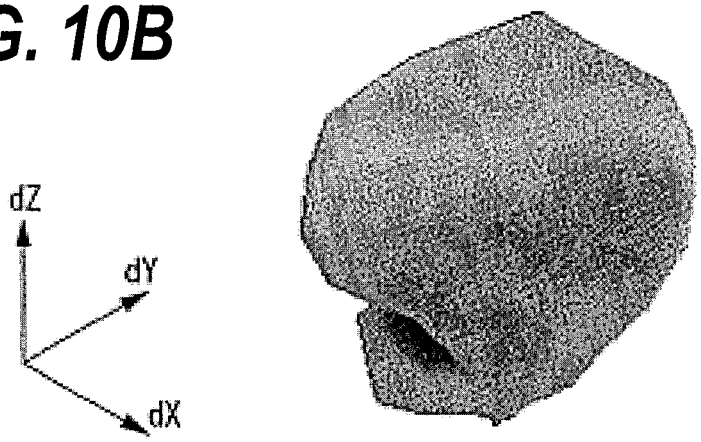
Figure 10C:
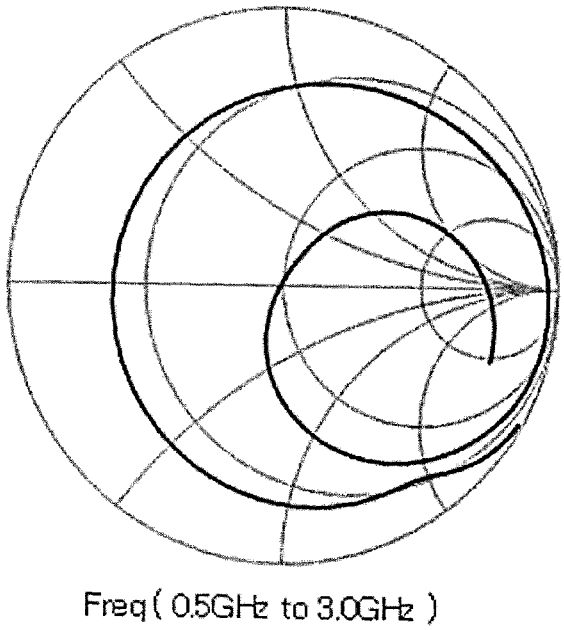
Figure 10D:
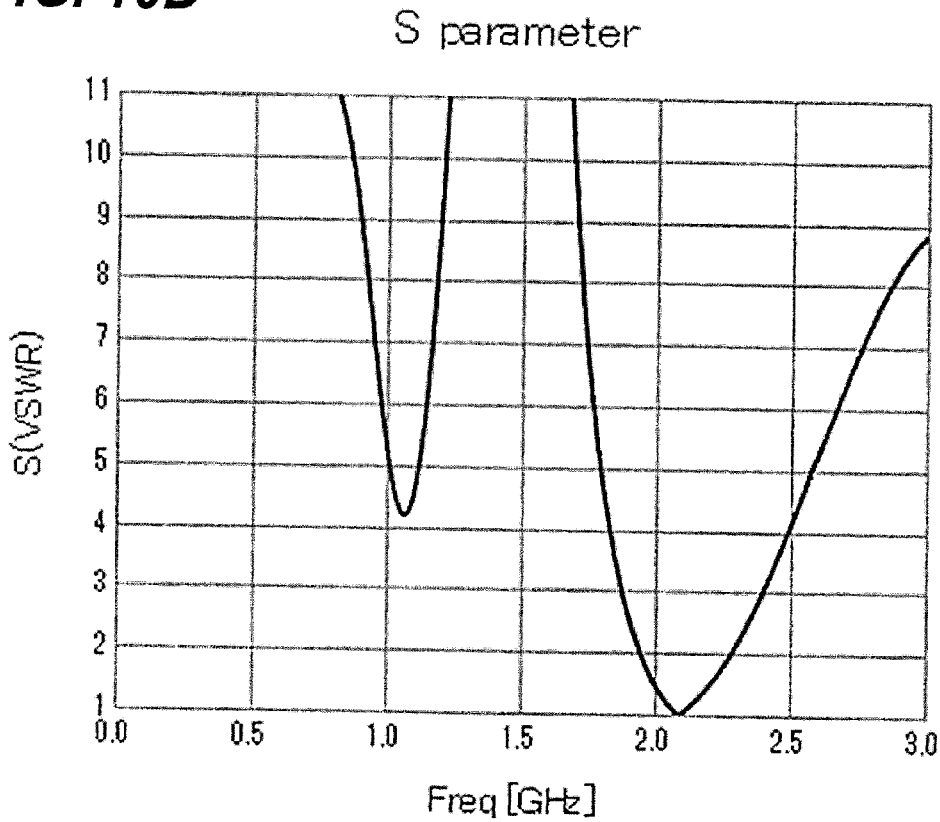
Figure 11A:
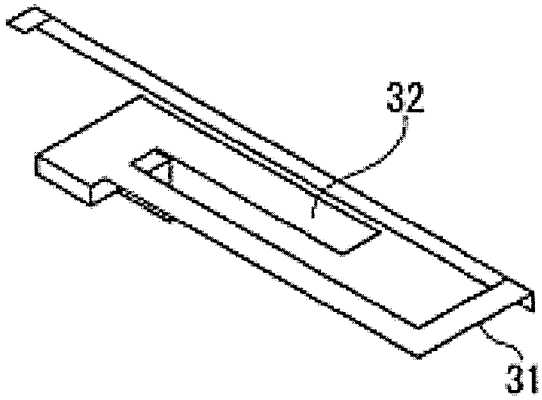
FIGS. 11A-D illustrate SAR simulations for another exemplary antenna.

Next, FIGS. 10A-D illustrate exemplary SAR simulations for an antenna without the second element 32 (see, e.g., FIG. 10A), and FIGS. 11A-D illustrate exemplary SAR simulations for an antenna that includes the second element 32 (see, e.g., FIG. 11A). These simulations were performed according the following conditions.

Calculation of $\lambda_{g1}$

Lengths L1 and L2 are respectively matched with the minimum frequency band (900 MHz) and an LTE countermeasure band (2500-2570 MHz), and $\lambda_{g1}$ is computed.

$$\begin{aligned}\lambda_{g1} &= C/f_1 * 1/\sqrt{\varepsilon r}\\ &= (300*10^8)/(2500*10^6)*1/\sqrt{\varepsilon r}\\ &= 120*1/\sqrt{\varepsilon r}\end{aligned}$$

Here, C is the speed of light in a vacuum, $f_1$ is a minimum frequency of the countermeasure band, ∈r is a dielectric constant of a medium, and $\lambda_{g1}$ is calculated in millimeters.

Although the first element 31 and the second element 32 are arranged on the surface of the antenna substrate 20, which is a dielectric material, since a single surface is open, there are few wavelength shortening effects present. Therefore, based on a simulator result, ∈r is set to a value at which $1/\sqrt{\in r}=0.85$, which yields:

$$\lambda_{g1}=120*0.85=102 \text{ mm}$$

Dimension conditions are then computed as follows:

Length of the First Element 31 (L1):

$$63.75 \text{ mm} < L1 < 89.25 \text{ mm}$$

Length of the Second Element 32 (L2):

$$L2 <= 25 \text{ mm}$$

As mentioned earlier, the directivity shown in FIGS. 10A-D is an example where only the first element 31 is present in the antenna. The directivity of this antenna is characteristically emitted from the +Y-axis to the +Z-axis. FIG. 10B shows antenna directivity in a case with a frequency of 2.55 GHz. The maximum directivity value in this case is 2.5 dBi. FIGS. 10C and 10D show an S parameter (S11) of the antenna with only the first element 31, where S11 is defined by the following formula:

$$S11=10 \log [10]*(\text{reflective electric power})/(\text{incident electric power to an antenna})$$

FIG. 10C is a Smith chart showing impedance from 0.5 GHz to 3.0 GHz, with a normalization impedance of 50 ohms. FIG. 10D shows VSWR for the frequency range of FIG. 10C, where the VSWR value of 1 is illustrated (ideal state), as well as states with much higher loss levels, which is undesirable. As shown in FIG. 10D, a first anti-resonance frequency exists at 1500 MHz, with the VSWR value quite high at 11 or more.

Next, FIGS. 11A-D provide corresponding illustrations to FIG. 10A-D for the case where the antenna 30 has both the first element 31 and the second element 32. The exemplary illustrations of FIGS. 11A-D assume the following parameters:

$La$=20.0 mm $X$=2.0 mm $Y$=2.0 mm

Figure 11B:
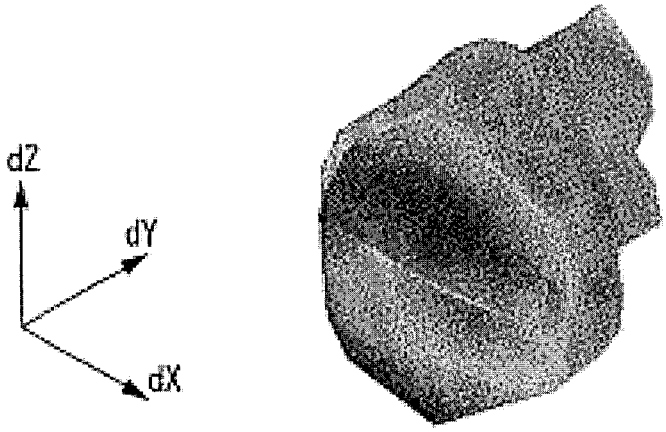
Figure 11C:
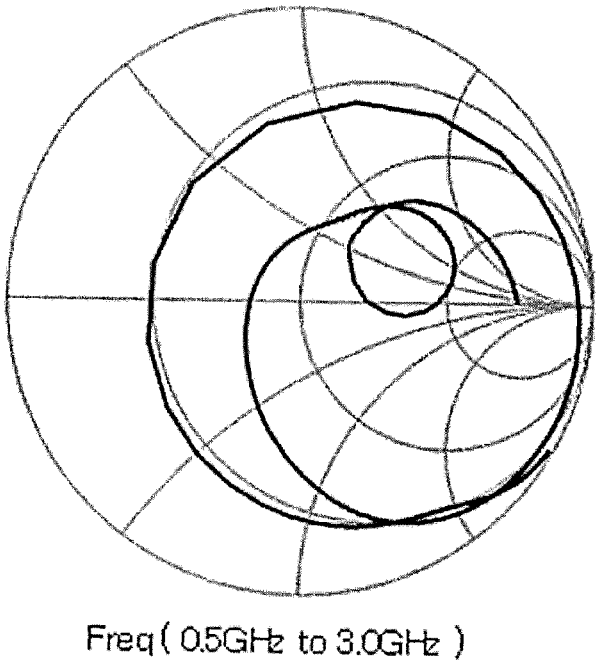
Figure 11D:
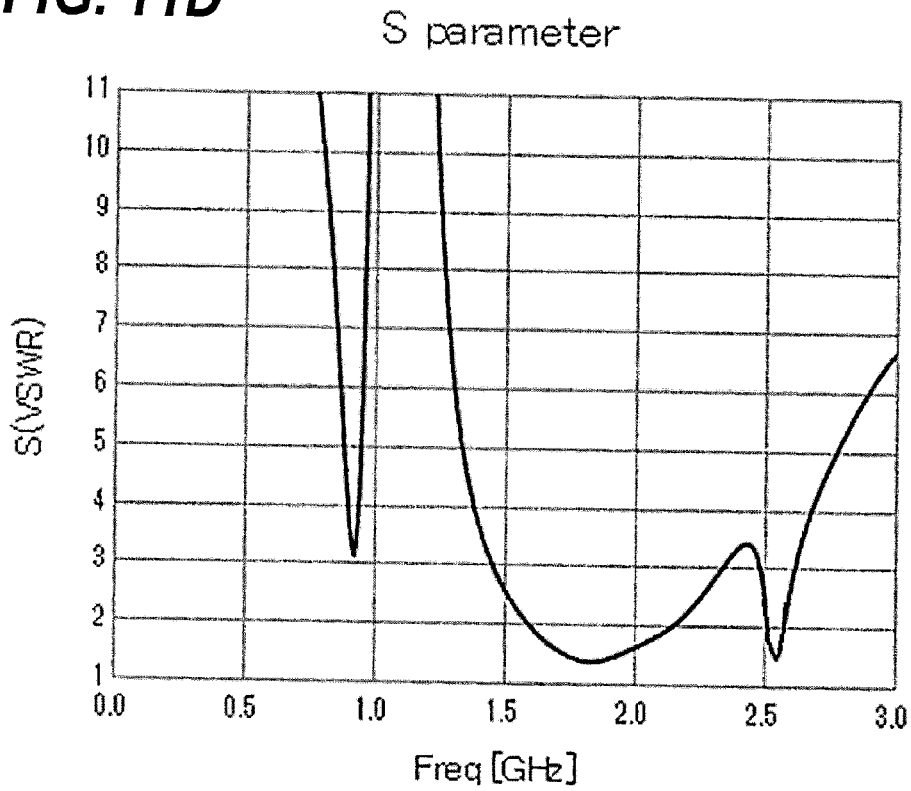

FIG. 11B shows the antenna directivity from FIG. 11A in a case with a frequency of 2.55 GHz. The maximum directivity value in this case is 3.5 dBi. FIGS. 11C and 11D show the S parameter (S 11) of the antenna. FIG. 11C is a Smith chart showing impedance from 0.5 GHz to 3.0 GHz, with a normalization impedance of 50 ohms. FIG. 11D shows VSWR for the frequency range of FIG. 11C. As illustrated in FIG. 11D, the directivity at the 2.5 GHz frequency band, which is the frequency band that needs countermeasures against SAR, is changing a lot so that it may turn out that the directivity of FIG. 11B is comparable with the directivity of FIG. 10B. Moreover, as shown in FIG. 11D, a first anti-resonance frequency exists at 1200 MHz, and VSWR(s) are typically 3 or less and at low values. Thus, under this condition, favorable directional characteristics are acquired, and the antenna 30 has a high performance improvement in the frequency band of 1500 MHz.

Figure 12A:
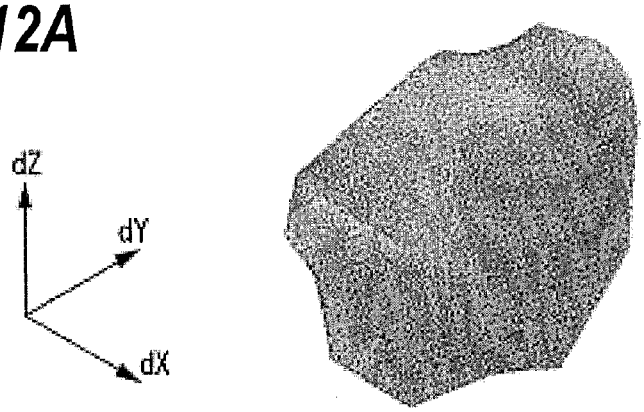
FIGS. 12A and 12B illustrate directivity characteristics for an exemplary antenna.
Figure 12B:
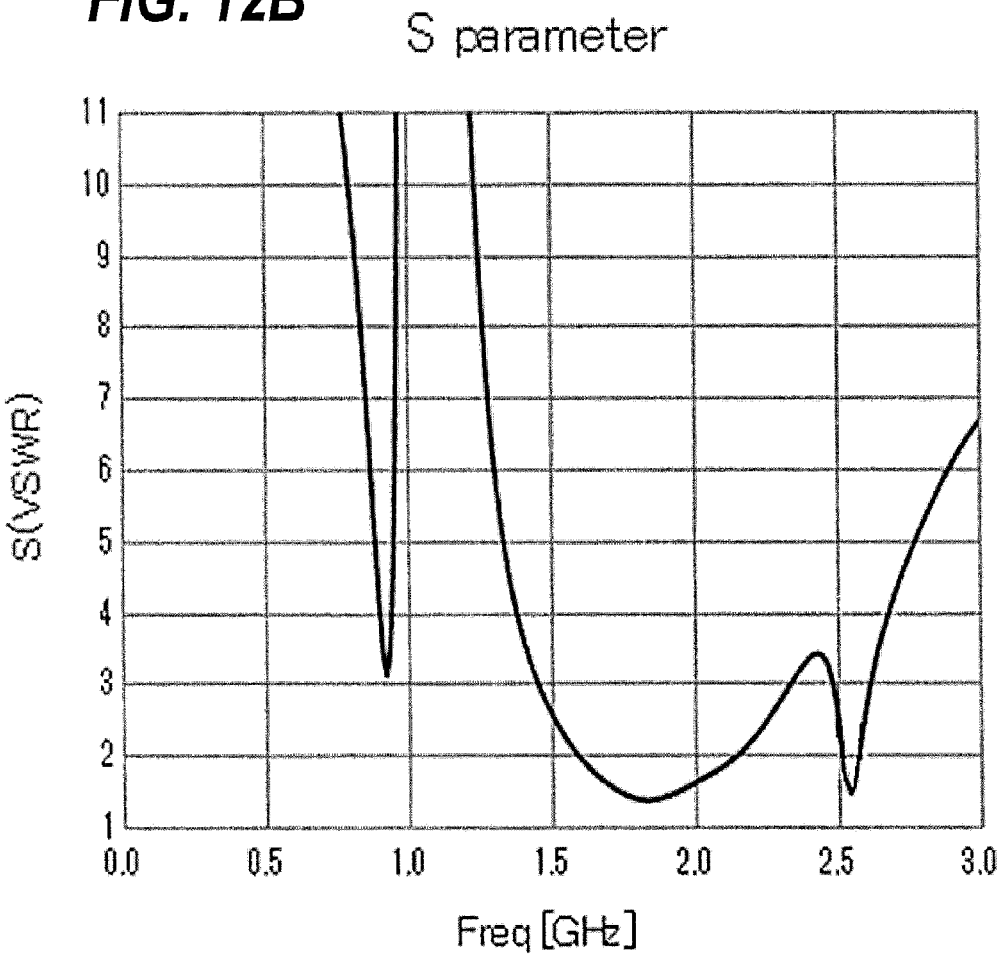

FIGS. 12A and 12B illustrate antenna 30 directivity characteristics in a case with the following parameters:

$La$=21.0 mm $X$=2.0 mm $Y$=2.0 mm

The directivity in this case is shown in FIG. 12A, and FIG. 12B shows corresponding VSWR for the frequency range of FIG. 12A. As illustrated in these figures, directivity and VSWR are changing from the example of FIGS. 11A-D, which illustrates the effect changing the above parameters has on antenna performance. In the example of FIGS. 12A and 12B, directivity is getting worse relative to the example of FIGS. 11A-D. Moreover, VSWR at 2550 MHz has deteriorated to approximately 4 or 5.

Figure 13A:
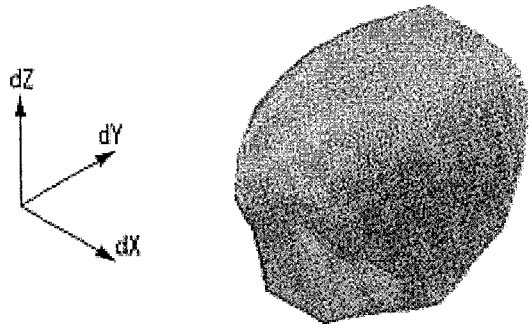
FIGS. 13A and 13B illustrate directivity characteristics for another exemplary antenna.
Figure 13B:
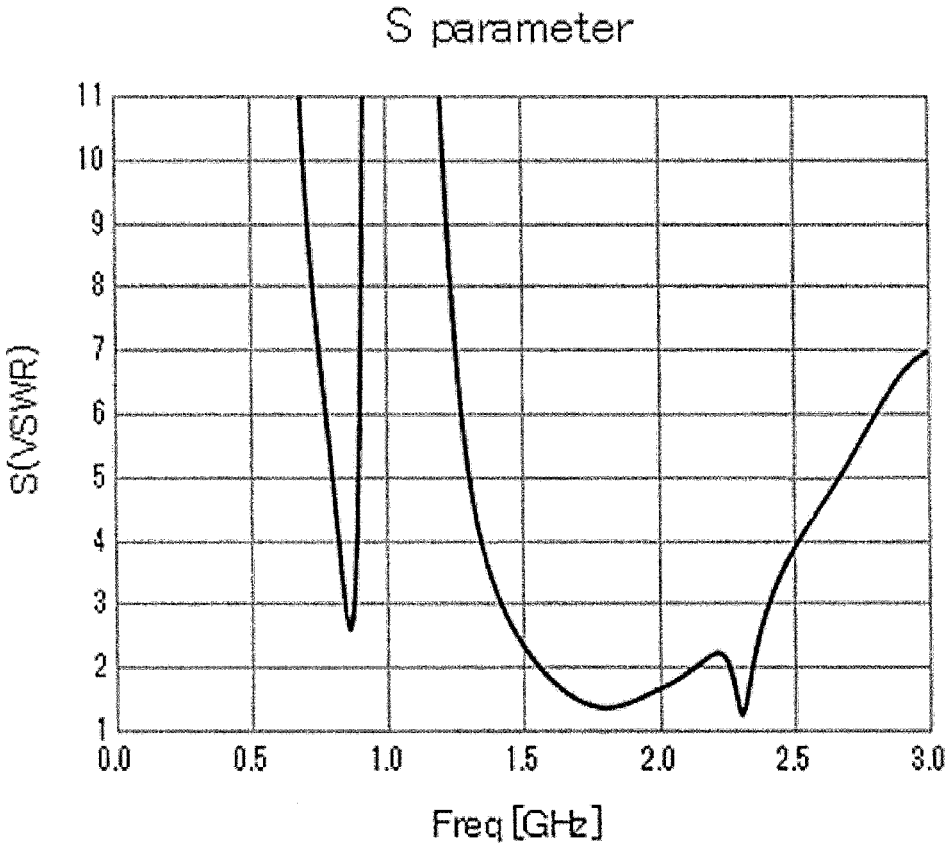

FIGS. 13A and 13B illustrate antenna 30 directivity characteristics in a case with the following parameters:

$La$=21.0 mm $X$=0.5 mm $Y$=3.5 mm

The directivity in this case is shown in FIG. 13A, and FIG. 13B shows corresponding VSWR for the frequency range of FIG. 13A. As illustrated in these figures, directivity is not optimal under these conditions, and VSWR at 2550 MHz is also high.

Figure 14A:
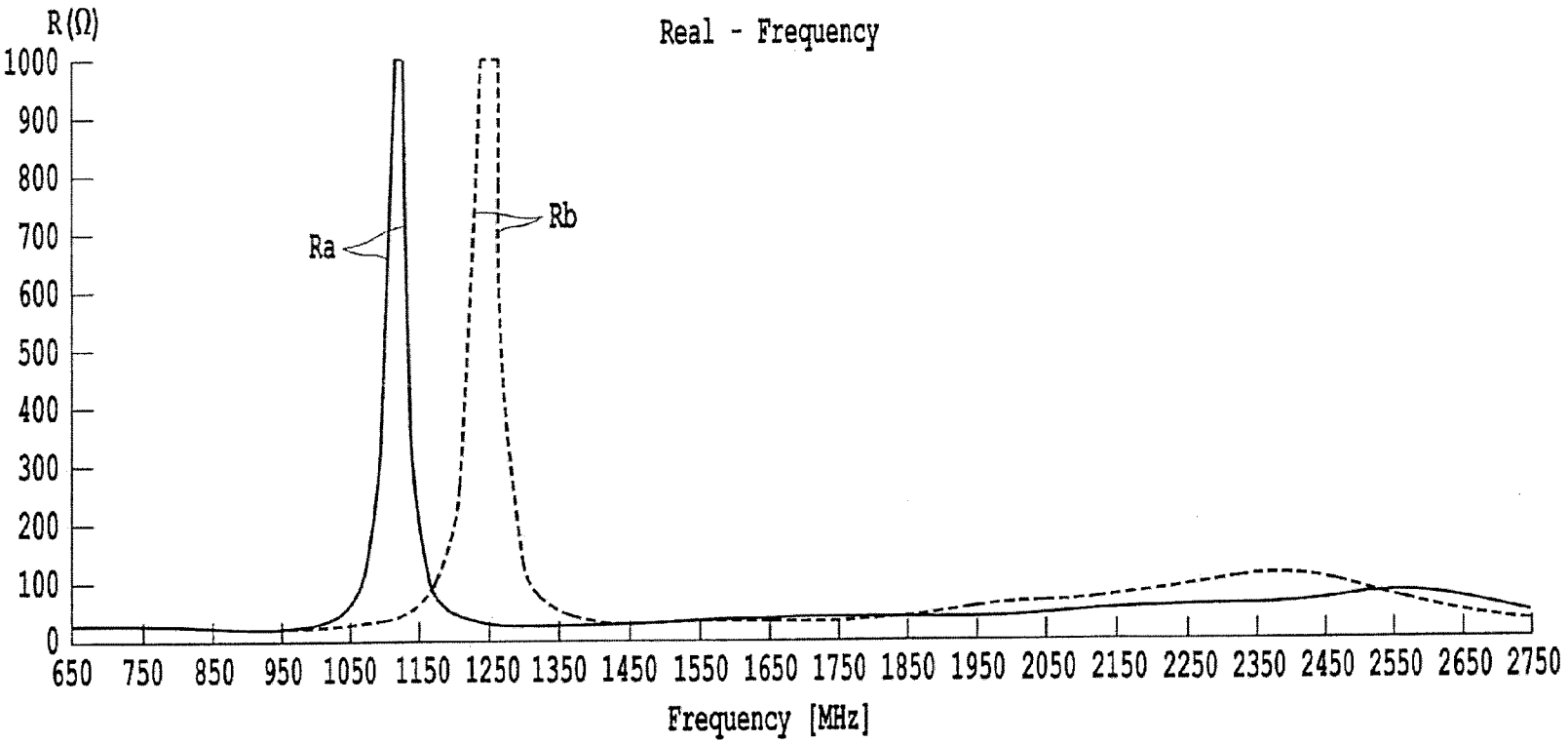
FIGS. 14A and 14B show impedance characteristics for exemplary antennas.
Figure 14B:
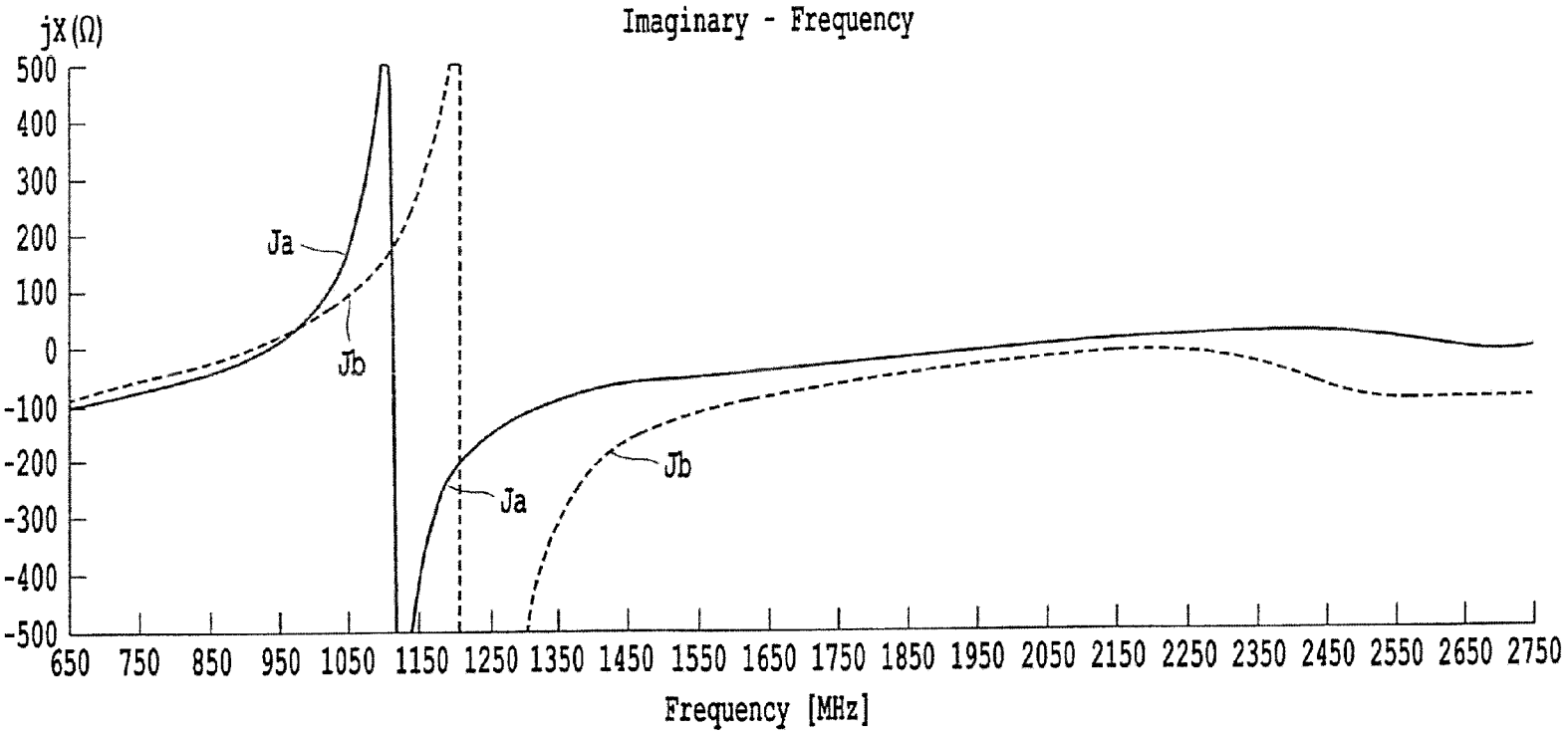

Next, FIGS. 14A and 14B show impedance characteristics (Rb and Jb) of an antenna having only the first element 31 (i.e., no second element 32), and impedance characteristics of an antenna having both the first element 31 and the second element 32 (Ra and Ja). FIGS. 14A and 14B assume the following parameters:

$La$=20.5 mm $X$=2.0 mm $Y$=3.0 mm

FIG. 14A shows the real portion of impedance characteristics Ra and Rb, and FIG. 14B shows the imaginary portion of impedance characteristics Ja and Jb. As shown in these figures, in the case of the antenna with only the first element 31 (i.e., impedance Rb and Jb), a first anti-resonance condition exists at 1250 MHz, and this high impedance state continues to the 1600 MHz vicinity. On the other hand, in the case of the antenna which has the second element 32 (i.e., impedance Ra and Ja), the first anti-resonance has moved to 1100 MHz. Although the high impedance state continues to the 1300 MHz vicinity, the impedance is comparatively low at greater than 1400 MHz relative to the case with only the first element 31.

Figure 15:
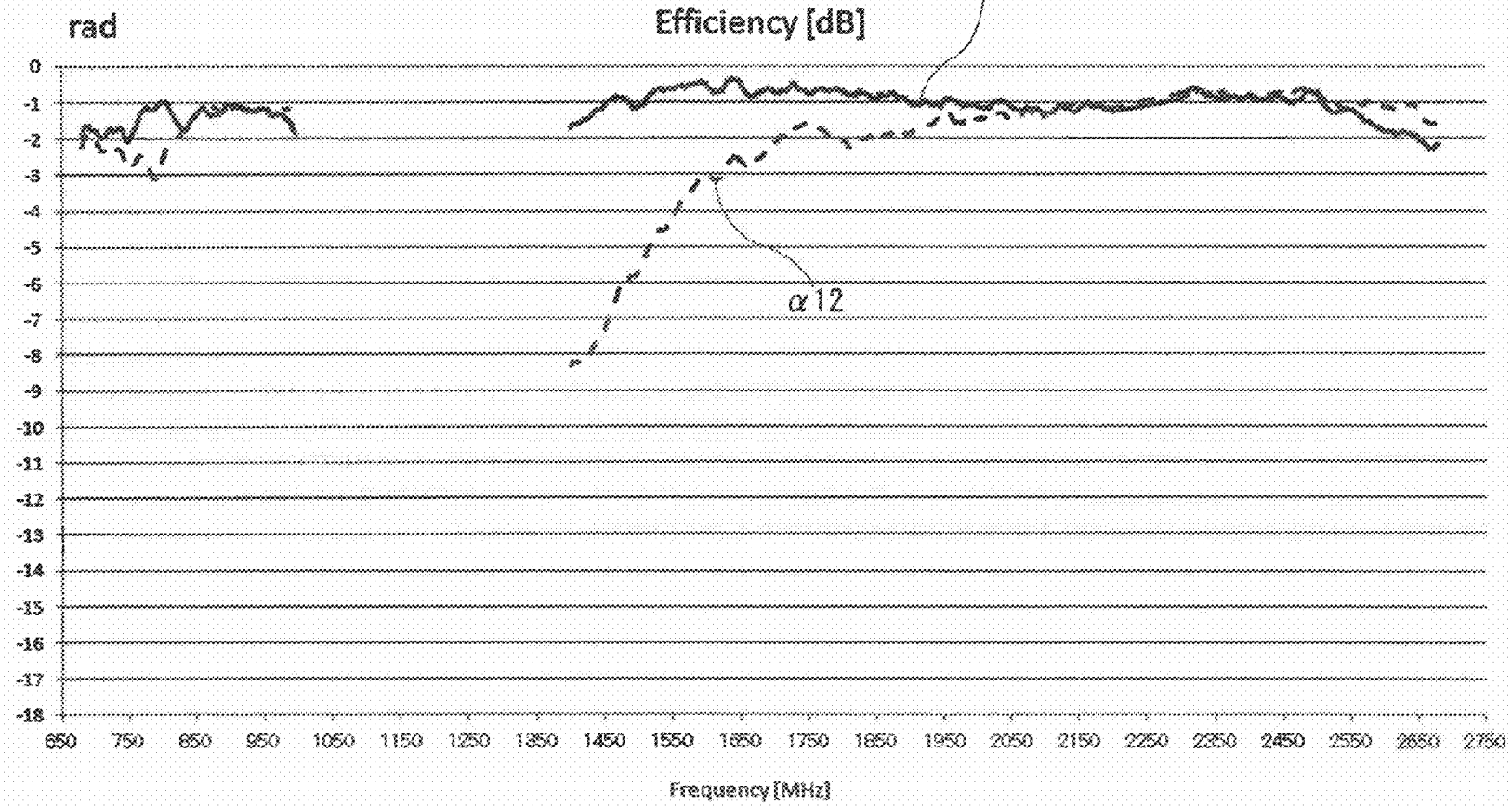
FIG. 15 illustrates radiation efficiency for the antennas of FIGS. 14A and 14B.

Next, FIG. 15 shows radiation efficiency $\alpha 11$ of an antenna having both the first element 31 and the second element 32, such as the antenna 30, and the radiation efficiency $\alpha 12$ of and antenna having only the first element 31. The exemplary radiation efficiency characteristics shown in FIG. 15 assume power is supplied to the antenna under perfect adjustment conditions. As shown in the figure, the radiation efficiency $\alpha 11$ is significantly improved compared with the radiation efficiency $\alpha 12$ in the 1.4 GHz vicinity. Moreover, the antenna having the second element 32 exhibits a gentler change in reactance in the 1.4 GHz vicinity, and its change of real impedance is also relatively gentle. Thus, these exemplary graphs show that the bandwidth increase of the direction of the antenna that has the second element 32 is carried out.

Figure 16:
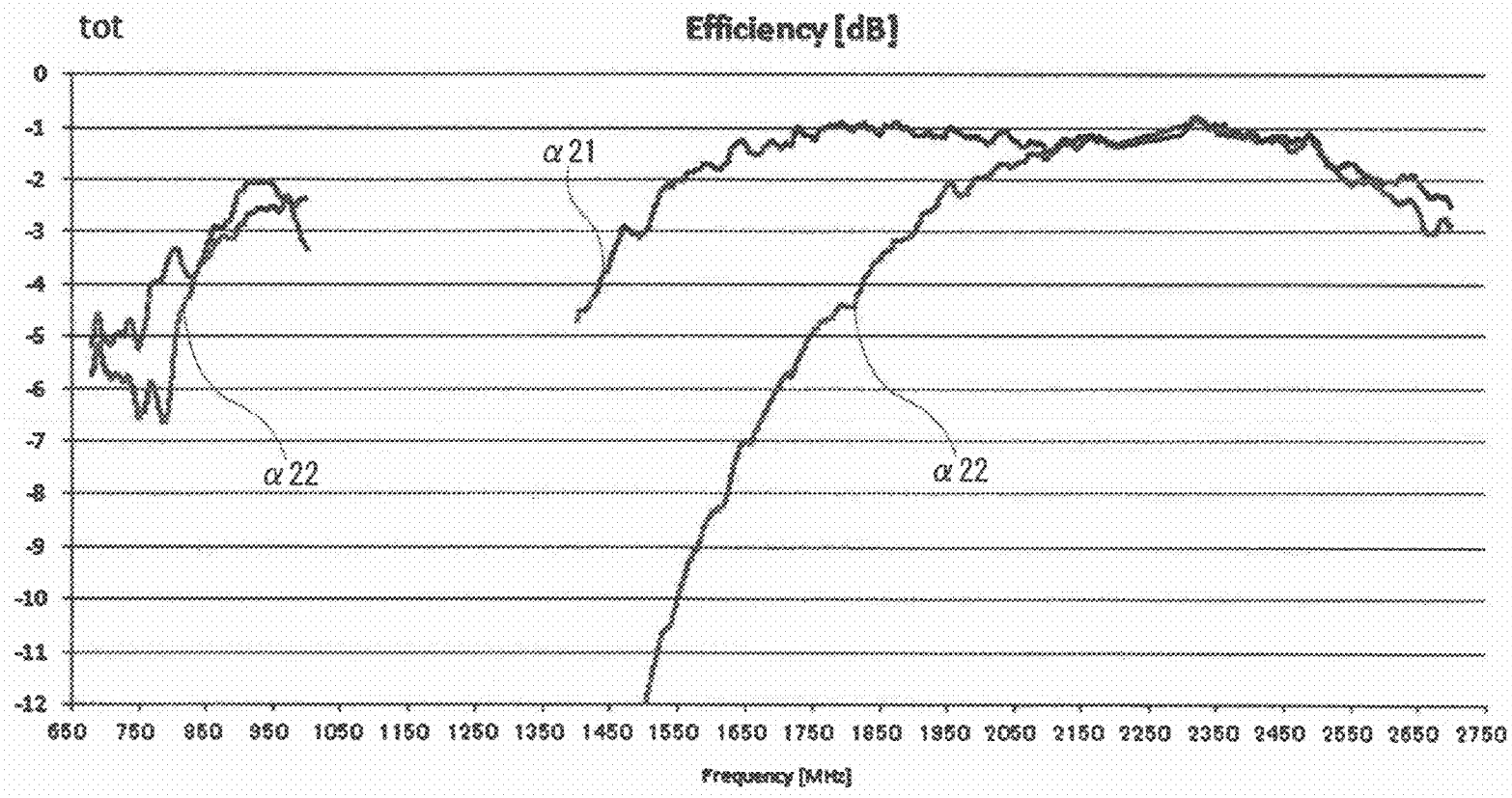
FIG. 16 illustrates radiation efficiency for an alternate condition using the antennas of FIGS. 14A and 14B.

Next, FIG. 16 illustrates radiation efficiency in a condition with 50 ohms in impedance without a matching circuit, and when transmission power is supplied to an antenna. In this case, the radiation efficiency $\alpha 21$ in the case of the antenna that has both the first element 31 and the second element 32 (e.g., antenna 30) has been significantly improved in the 1.4 GHz vicinity compared with the radiation efficiency $\alpha 22$, which does not have the second element 32.

Figure 17A:
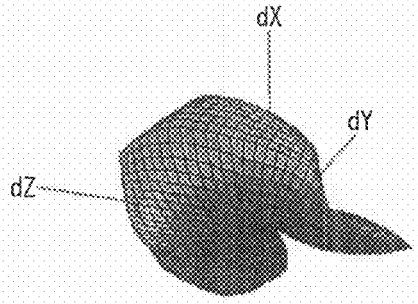
FIGS. 17A and 17B illustrate directivity features for an antenna without a second element.
Figure 17B:
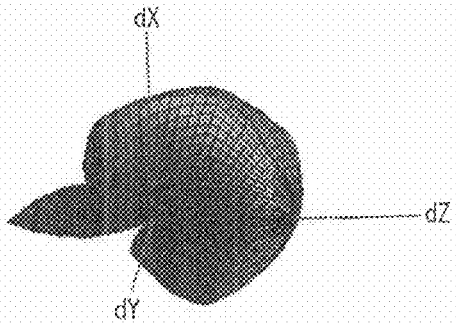
Figure 18A:
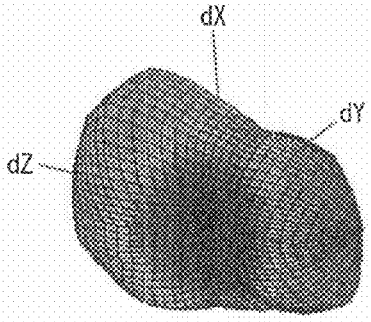
FIGS. 18A and 18B illustrate directivity features for an antenna that includes a second element.
Figure 18B:
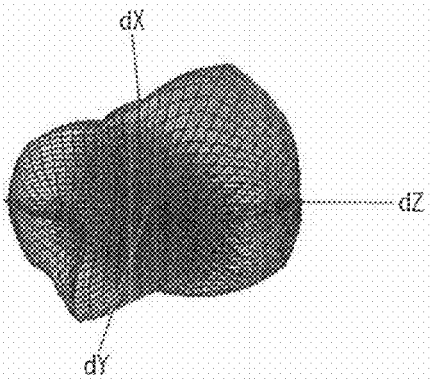

Next, FIGS. 17A and 17B illustrate directivity features for an antenna without the second element 32, and FIGS. 18A and 18B illustrate directivity features for an antenna that includes the second element 32 (e.g., antenna 30). These figures assume the following parameters:

$La$=20.0 mm $X$=2.0 mm $Y$=3.0 mm

FIGS. 17A-B and 18A-B respectively illustrate directivity features of the same antenna, but FIG. 17/18B shifts the axes dY and dZ relative to FIG. 17/18A. As seen in the exemplary graphs of FIGS. 18A and 18B, the inclusion of the second element 32 results in increased directivity dispersion along the various axes.

Next, FIG. 19 shows exemplary SAR measurements in tabular form for the case in which the antenna does not include the second element 32, as well as the case in which the second element 32 is included, such as in the antenna 30. Calculated values are shown for both cases when the antenna is positioned 10 mm and 15 mm from a human body. As shown in the table, for both distances, SAR is significantly reduced when the second element 32 is included in the antenna.

Figure 20A:
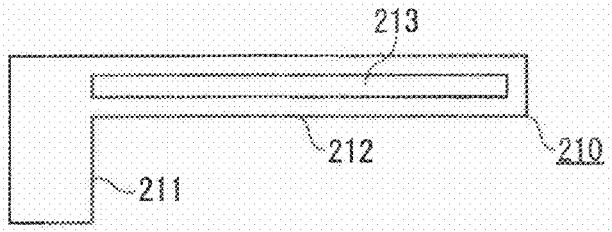
FIGS. 20A-20N illustrate exemplary modifications for a second element on an exemplary antenna.
Figure 20B:
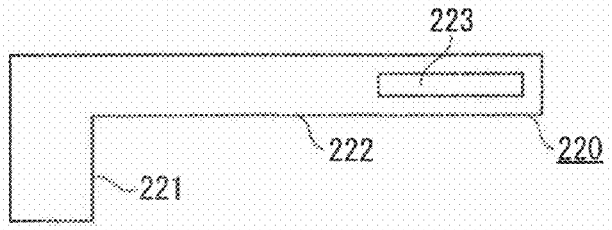
Figure 20C:
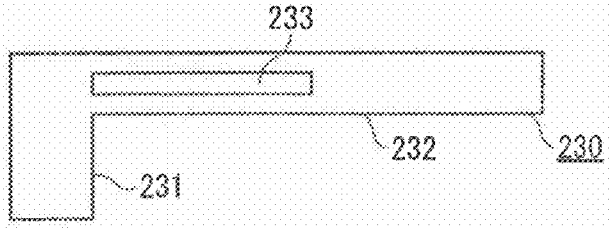
Figure 20D:
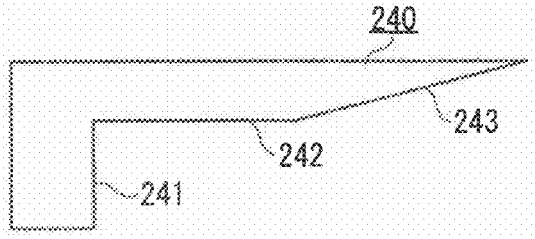
Figure 20E:
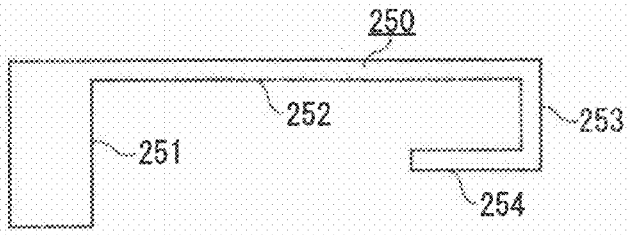
Figure 20F:
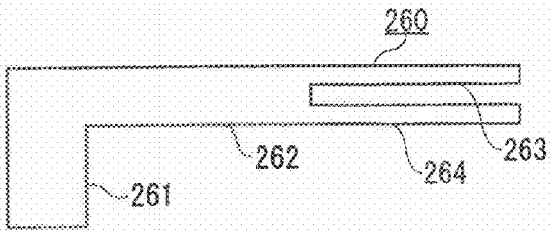
Figure 20G:
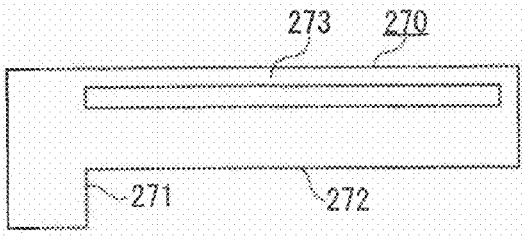
Figure 20H:
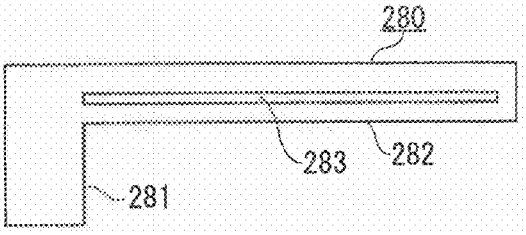
Figure 20I:
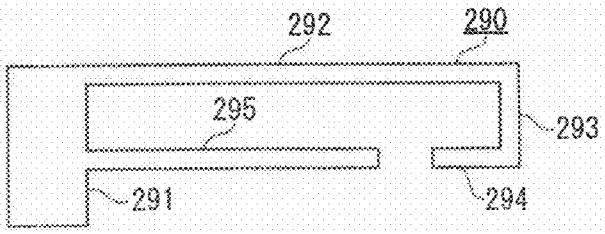
Figure 20J:
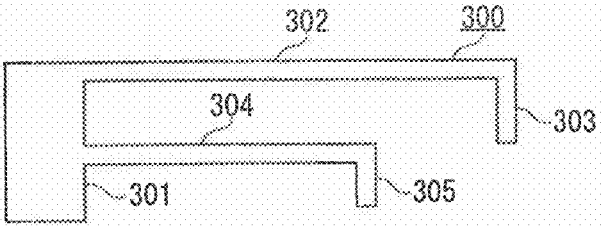
Figure 20K:
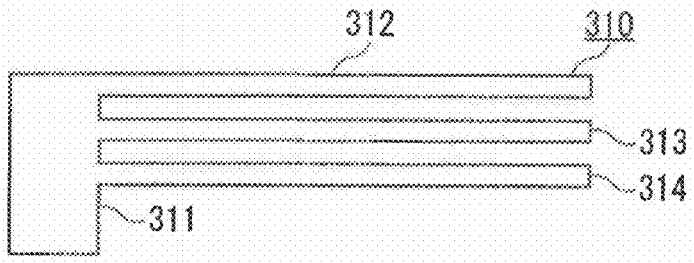
Figure 20L:
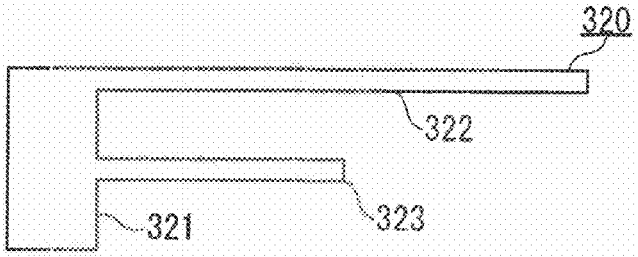
Figure 20M:
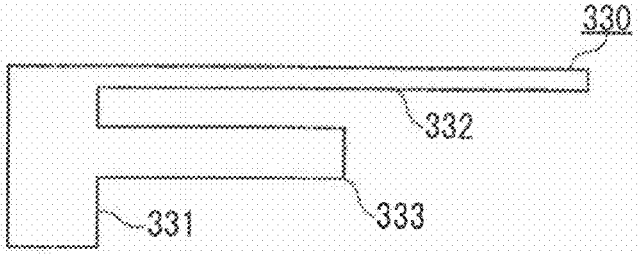
Figure 20N:
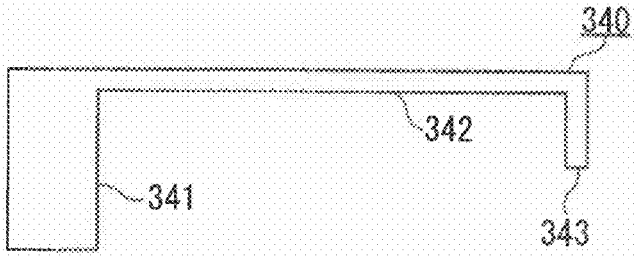

Next, FIGS. 20A through 20N illustrate exemplary modifications for a second element, such as the second element 32 of FIG. 4, which can be used in an antenna for balancing increased bandwidth with SAR countermeasures. It should be noted that the exemplary second element configurations are merely examples presented for illustration purposes, and other configurations could easily be implemented within the scope of the present disclosure.

Referring first to FIG. 20A, an exemplary second element 210 is shown with a component 211 and a component 212 connecting in an L-shape. Additionally, the component 212 includes an opening part 213, which may be provided in substantially the entire elongated length of the component 212.

Next, FIG. 20B shows an exemplary second element 220. The second element 220 includes a component 221 connected with a component 222 to form an L-shape. Additionally, the component 222 includes an opening part 223, which is provided at a front end of the component 222.

Next, FIG. 20C shows an exemplary second element 230. The second element 230 includes a component 231 connected with a component 232 to form an L-shape. Additionally, the component 232 includes an opening part 233, which is provided in the component 232 in the vicinity of a connection portion (i.e., an adjacent edge) of the component 231.

Next, FIG. 20D shows an exemplary second element 240. The second element 240 includes a component 241 connected with a component 242 to form an L-shape. Additionally, the component 242 includes an inclination part 243 at a front tip of the component 242.

Next, FIG. 20E shows an exemplary second element 250. The second element 250 includes a component 251, a component 252, a component 253, and a component 254, which may be respectively connected at right angles.

Next, FIG. 20F shows an exemplary second element 260. The second element 260 includes a component 261 connected with a component 262 to form an L-shape. Additionally, the component 262 has a thin component 263 and thin component 264, which bifurcate the component 262 at a front tip.

Next, FIG. 20G shows an exemplary second element 270. The second element 270 includes a component 271 connected with a component 272 to form an L-shape. The second element 270 is similar to the second element 210 of FIG. 20A, but the component 272 is wider than the component 212. Additionally, the component 272 is equipped with an opening part 273, which may be provided in substantially the entire elongated length of the component 272, and may be centered or offset in a width direction of the component 272.

Next, FIG. 20H shows an exemplary second element 280. The second element 280 includes a component 281 connected with a component 282 to form an L-shape. The second element is similar to the second element 210 of FIG.

20A, but with an opening part 283 in the component 282 that is narrower than the opening part 213.

Next, FIG. 20I shows an exemplary second element 290. The second element 290 includes a component 291, a component 292, the component 293, a component 294, and a component 295. The component 291 and the component 292 are connected to form an L-shape. The component 293 is connected at a front tip of the component 292. The component 294 has a length that is shorter than the component 292, and the component 294 is connected at a front tip of the component 293. Moreover, the component 295 is connected to an edge of the component 291 such that a front tip of the component 294 opposes a front tip of the component 295.

Next, FIG. 20J shows an exemplary second element 300. The second element 300 includes a component 301, a component 302, a component 303, a component 304, and a component 305. The component 301 and the component 302 are connected to form an L-shape. The component 303 is connected at a front tip of the component 302. The component 304 is connected to an edge of the component 301. The component 305 is connected at the front tip of the component 304. The component 305 may curve from the front tip of the component 304 in a direction corresponding to, or opposing, the component 303.

Next, FIG. 20K shows an exemplary second element 310. The second element 310 includes a component 311 connected with a component 312 to form an L-shape. Additionally, the second element 310 includes a component 313 and a component 314, which are arranged substantially in parallel with the component 312. The component 313 and the component 314 are connected to an edge of the component 311.

Next, FIG. 20L shows an exemplary second element 320. The second element 320 includes a component 321 connected with a component 322 to form an L-shape. Additionally, the second element 310 includes a component 323 is arranged substantially in parallel with the component 322. The component 323 is connected to an edge of the component 321, and the component 323 is shorter than the component 322.

FIG. 20M shows an exemplary second element 330. The second element 330 includes a component 331 connected with a component 332 to form an L-shape. Additionally, the second element 330 includes a component 333 arranged substantially in parallel with the component 332. The component 333 is connected to an edge of the component 331, and the component 333 is shorter and wider than the component 332.

FIG. 20N shows an exemplary second element 340. The second element 340 includes a component 341 connected with a component 342 to form an L-shape. Additionally, the second element 330 includes a component 343 connected at a front tip of the component 342.

As stated previously, the second elements 210-340 described above with respect to FIGS. 20A to 20N, or any combination of elements thereof, may be utilized as a second element when forming a multi-band antenna of the present disclosure, such as the antenna 30 of FIG. 4.

Figure 21A:
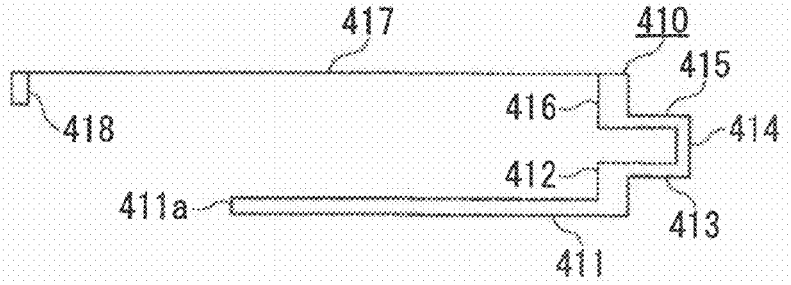
FIGS. 21A-21I illustrate exemplary modifications for a first element on an exemplary antenna.
Figure 21B:
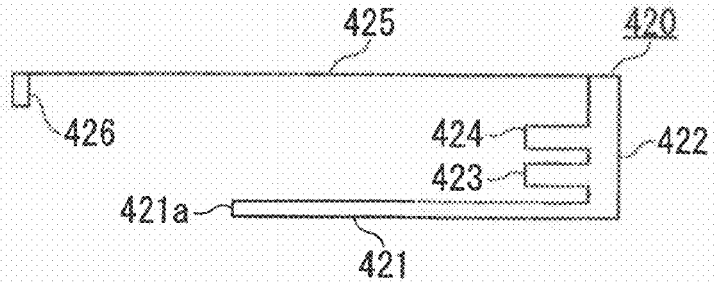
Figure 21C:
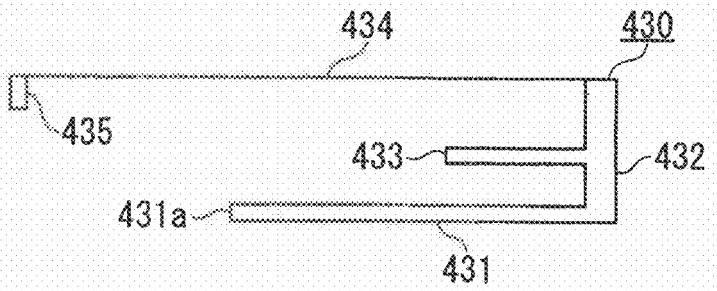

Next, FIGS. 21A to 21C illustrate exemplary modifications for a first element, such as the first element 31 of FIG. 4, which can be used in an antenna for balancing increased bandwidth with SAR countermeasures. It should be noted that the exemplary first element configurations are merely examples presented for illustration purposes, and other configurations could easily be implemented within the scope of the present disclosure.

Turning first to FIG. 21A, an exemplary first element 410 includes components 411, 412, 413, 414, 415, 416, 417, and 418. An end 411*a* of the component 411 may be connected to a second element (e.g., the second element 32). Components 411 through 418, in order, may be connected at right angles (i.e., the component 411 connects to the component 412, the component 412 connects to the component 413, etc.).

FIG. 21B illustrates an exemplary first element 420, which includes components 421, 422, 423, 424, 425, and 426. An end 421*a* of the component 421 may be connected to a second element (e.g., the second element 32). The component 423 and the component 424 are connected along an edge of the component 422. Further, the components 423 and 424 are arranged substantially in parallel with the components 421 and 425.

FIG. 21C illustrates an exemplary first element 430, which includes components 431, 432, 433, 434, and 435. An end 431*a* of the component 431 may be connected to a second element (e.g., the second element 32). The component 433 is connected along an edge of the component 432. Further, the component 433 is arranged in parallel with the components 431 and 434.

Figure 21D:
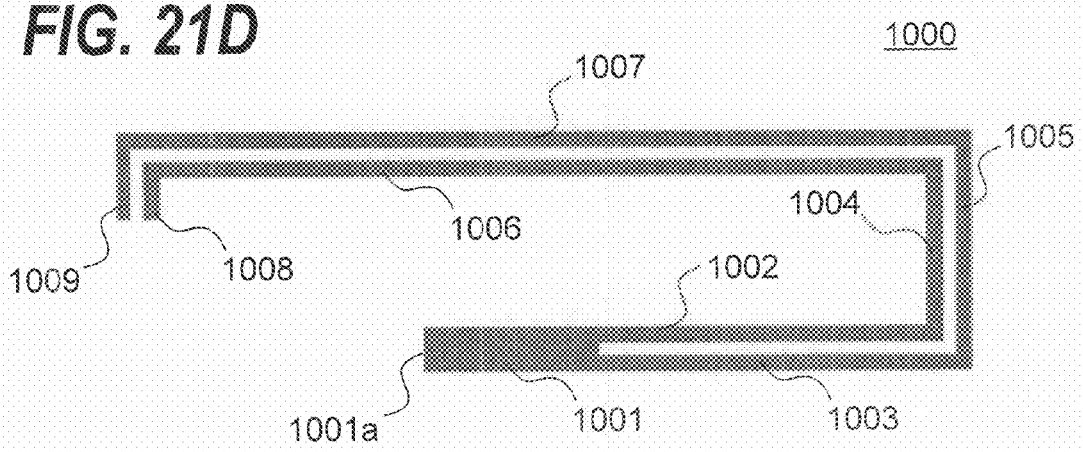

FIG. 21D illustrates an exemplary first element 1000, which includes components 1001, 1002, 1003, 1004, 1005, 1006, 1007, 1008, and 1009. An end 1001*a* of the component 1001 may be connected to a second element (e.g., the second element 32). Components 1001 through 1009, in order, may be connected at right angles (i.e., the component 1001 connects to the component 1002 and 1003, the component 1002 connects to the component 1008, the component 1003 connects to the component 1009, etc.).

Figure 21E:
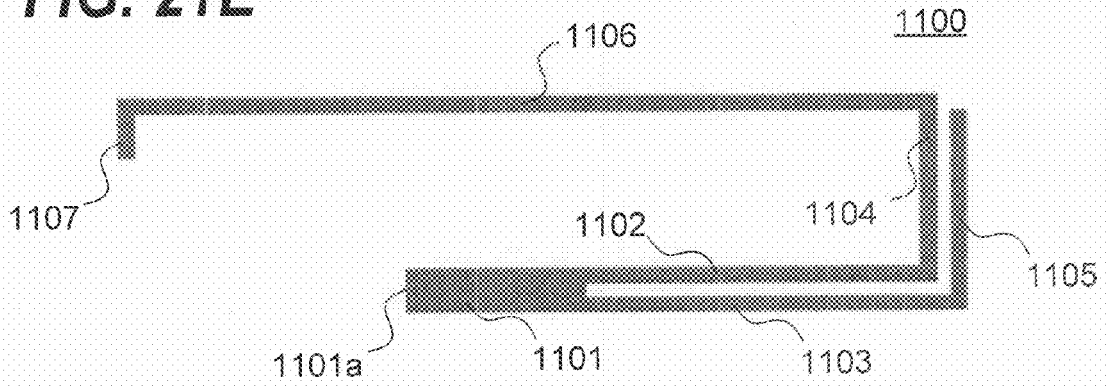

FIG. 21E illustrates an exemplary first element 1100, which includes components 1101, 1102, 1103, 1104, 1105, 1106, and 1107. An end 1101*a* of the component 1101 may be connected to a second element (e.g., the second element 32). The component 1102 and the component 1103 are each connected along an edge of the components 1104 and 1105, respectively.

Figure 21F:
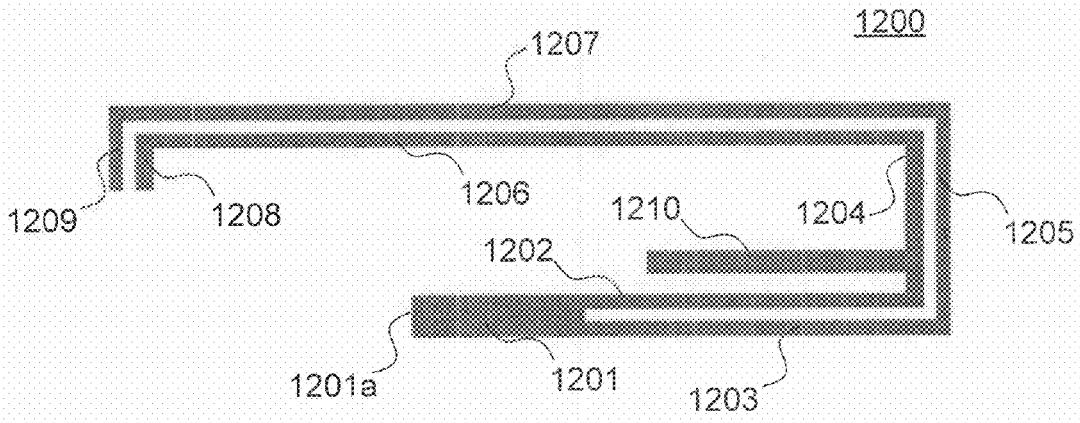

FIG. 21F illustrates an exemplary first element 1200, which includes components 1201, 1202, 1203, 1204, 1205, 1206, 1207, 1208, 1209, and 1210. An end 1201*a* of the component 1201 may be connected to a second element (e.g., the second element 32). The component 1210 is connected along an edge of the component 1204. Further, the component 1210 is arranged in parallel with the components 1202, 1203, 1206, and, 1207.

Figure 21G:
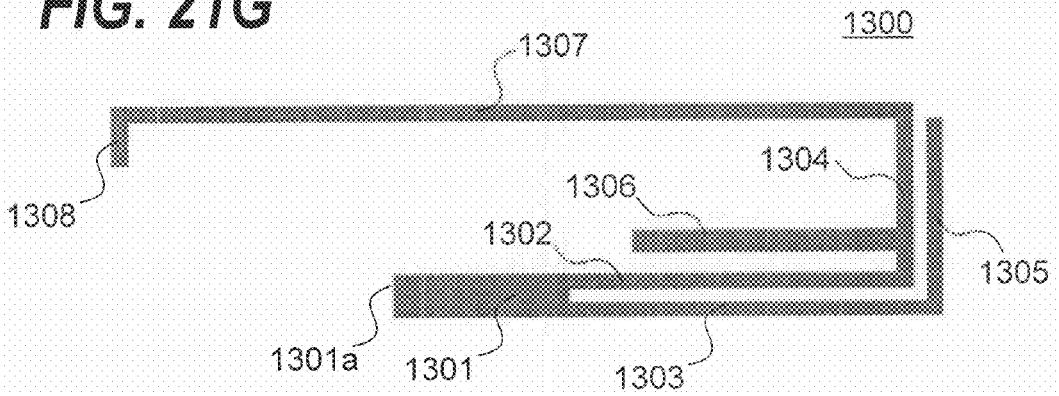

FIG. 21G illustrates an exemplary first element 1300, which includes components 1301, 1302, 1303, 1304, 1305, 1306, 1307, and 1308. An end 1301*a* of the component 1301 may be connected to a second element (e.g., the second element 32). The component 1306 is connected along an edge of the component 1304. Further, the component 1306 is arranged in parallel with the components 1302, 1303, and 1307.

Figure 21H:
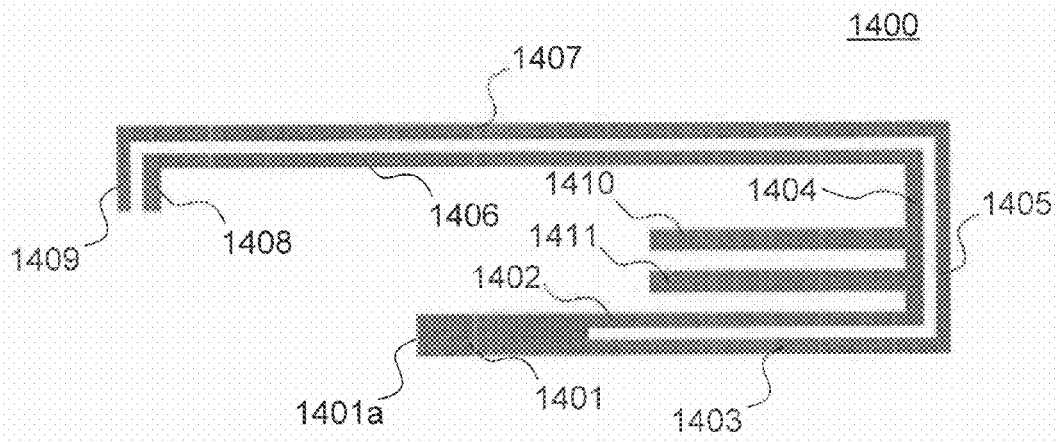

FIG. 21H illustrates an exemplary first element 1400, which includes components 1401, 1402, 1403, 1404, 1405, 1406, 1407, 1408, 1409, 1410, and 1411. An end 1401*a* of the component 1401 may be connected to a second element (e.g., the second element 32). The components 1410 and 1411 are connected along an edge of the component 1404. Further, the components 1410 and 1411 are arranged in parallel with the components 1402, 1403, 1406, and 1407.

Figure 21I:
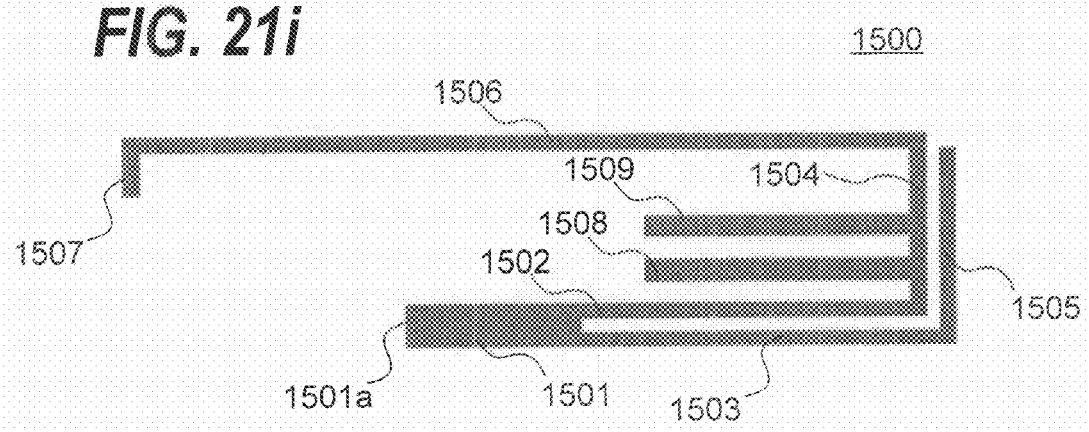

FIG. 21I illustrates an exemplary first element 1500, which includes components 1501, 1502, 1503, 504, 1505, 1506, 1507, 1508, and 1509. An end 1501*a* of the component 1501 may be connected to a second element (e.g., the second element 32). The component 1508 and 1509 are connected along an edge of the component 1504. Further, the component 1508 and 1509 are arranged in parallel with the components 1502, 1503, and 1506.

Figure 22:
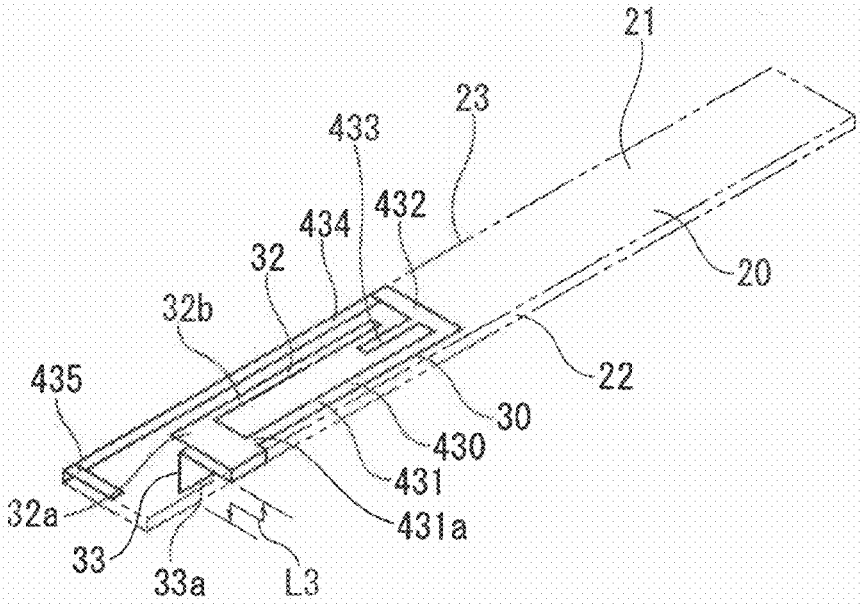
FIGS. 22 and 23 illustrate exemplary configurations of an antenna using alternate configurations of first and second elements.
Figure 23:
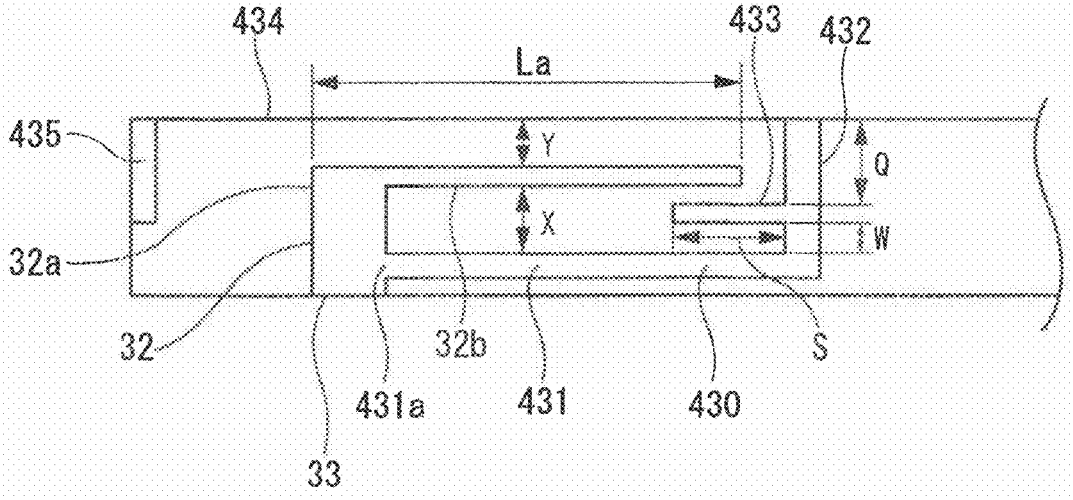

Next, FIGS. 22 and 23 illustrate exemplary configurations of the antenna 30 of FIG. 4 using alternate configurations of first and second elements, such as those described above for FIGS. 20A through 21C. As a non-limiting example, FIG. 22 shows the antenna 30 of FIG. 4 modified with the first element 430 of FIG. 21C. FIG. 23 shows a top-view perspective of FIG. 22, where it can be seen that the component 32*b* of the second element 32, and the component 433 of the first element 430, are separated by a predetermined clearance gap, and the two components overlap a common plane. Referring to FIG. 23, a length S is set to the elongated length of the component 433, a width W is set to the width between the an edge of component 430 and an edge of component 433, and a width Q is set to the width between an edge of the component 434 and an edge of the component 433.

Figure 24:
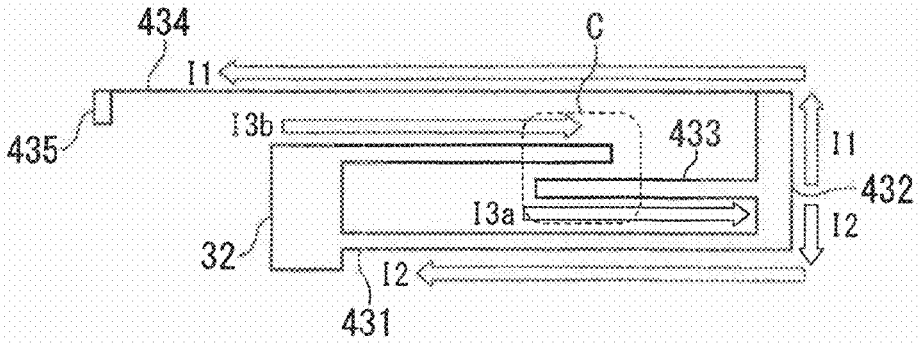
FIG. 24 illustrates current phasors of the exemplary antenna shown in FIG. 22.

Next, FIG. 24 illustrates an exemplary current phasor diagram of the antenna shown in FIG. 22. Here, the current phasor of the component 433 is set to I3a, and the current phasor of the component 32*b* of the second element 32 is set to I3b. In this example, the direction of the current phasor I3a and I3b is the same. For this reason, as shown in FIG. 24, an in-phase coupling C is generated by the component 433 and the component 32*b*. The current phasors I3a and I3b become large when the inductance L and capacitance C formed by the spacing of the two elements resonates. In addition, current phasors I1 and I2 have opposing phases relative to the current phasors I3a and I3b.

Generally there exists the following relationship between the resonant frequency $f_c$, the inductance L, and the capacitance C (Equation A):

$$f_c \propto \frac{1}{\sqrt{L * C}}$$

Here, since the denominator of Equation A will become large by the increased capacitance C when the structure of FIG. 24 is used, the resonant frequency $f_c$ becomes small. That is, it becomes possible to move the resonant frequency $f_1$ to a low frequency while keeping the length of the second element set. Thus, an arrangement such as that shown in FIG. 24 contributes to size reduction of a corresponding antenna.

Figure 25:
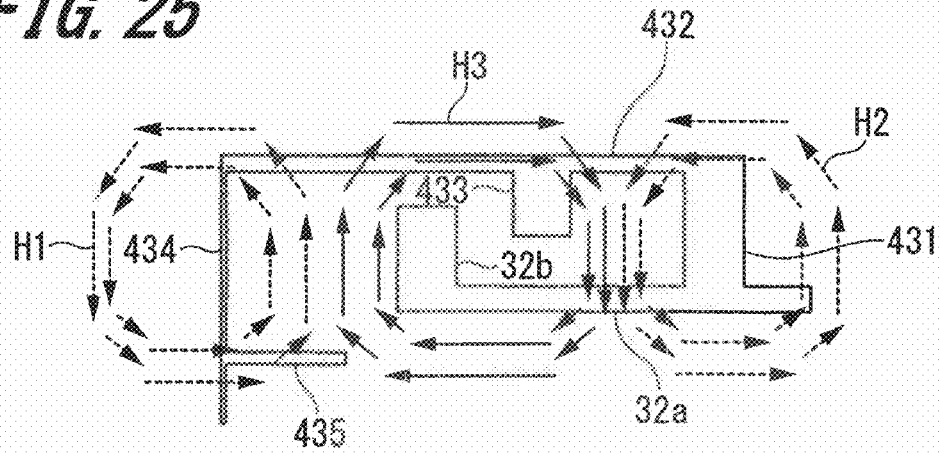
FIG. 25 illustrates magnetic field vectors generated in the exemplary antenna shown in FIG. 22.

FIG. 25 illustrates magnetic field vectors H1, H2, and H3 generated in the antenna shown in FIG. 22 (i.e., the magnetic field vectors resultant from the current phasors of FIG. 24). As shown in FIG. 25, the magnetic field vector H1 and the magnetic field vector H3 overlap, and the magnetic field vector H2 and the magnetic field vector H3 overlap. As a result of these overlaps, the overlapping magnetic field vectors may be added.

Next, FIGS. 26A-D illustrate antenna directivity characteristics for an exemplary case in which the first element of FIG. 22 does not include the component 433, and FIGS. 27A-D illustrate antenna directivity characteristics for an exemplary case in which the first element of FIG. 22 does include the component 433.

Referring to FIGS. 26A-D, the figures assume the following parameters:

*La*=19.0 mm

*X*=4.0 mm

*Y*=3.0 mm

Figure 26A:
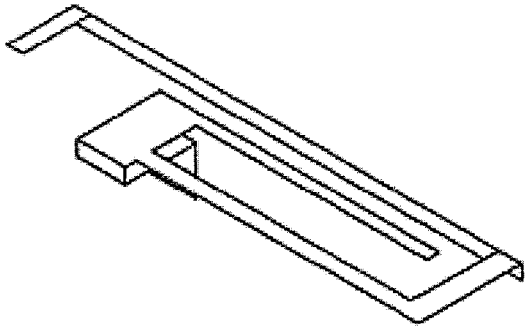
FIGS. 26A-D illustrate antenna directivity characteristics for an exemplary antenna.
Figure 26B:
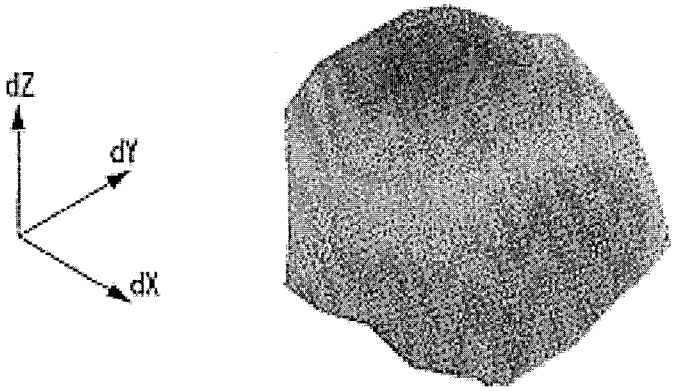
Figure 26C:
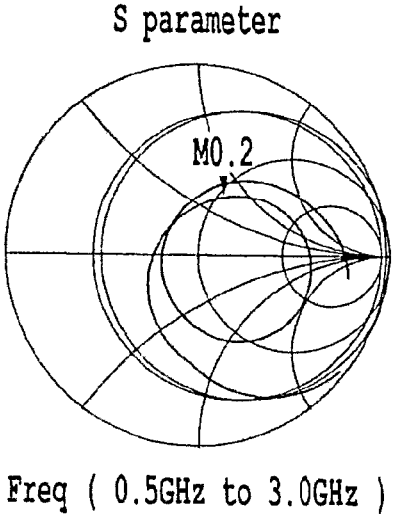
Figure 26D:
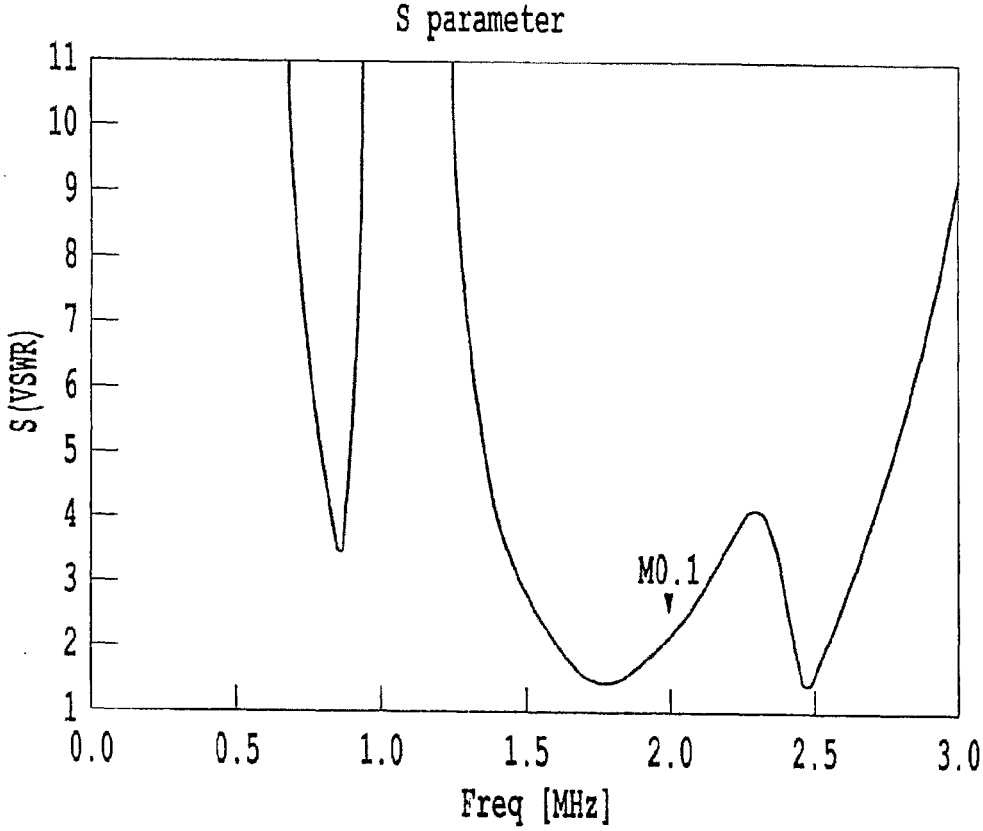

The directivity of the antenna shown in FIG. 26A is illustrated in FIG. 26B for a frequency of 1.95 GHz. The maximum directivity value in this case is 3.9 dBi. FIGS. 26C and 26D show S parameter (S11) of the antenna in FIG. 26A. In particular, FIG. 26C is a Smith chart that shows impedance from 0.5 GHz to 3.0 GHz, and FIG. 26D illustrates VSWR for a corresponding frequency range. As shown in FIG. 26D, a first anti-resonance frequency exists at 1500 MHz for this exemplary case, and VSWR is a value quite high at 11 or more.

Figure 27A:
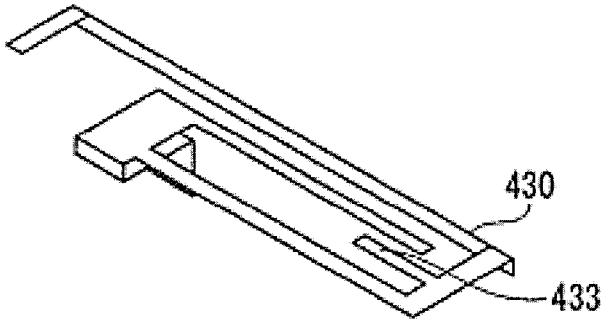
FIGS. 27A-D illustrate antenna directivity characteristics for an exemplary case in which the first element the antenna from FIGS. 26A-D is modified.

Turning to FIGS. 27A-27D, the directivity characteristics shown in illustrate the case of an antenna with the component 433 (e.g., FIG. 27A). The example of FIGS. 27A-27D assumes the following parameters:

*La*=19.0 mm

*X*=4.0 mm

*Y*=3.0 mm

*S*=12.0 mm

*Q*=5.0 mm

*W*=2.0 mm

Figure 27B:
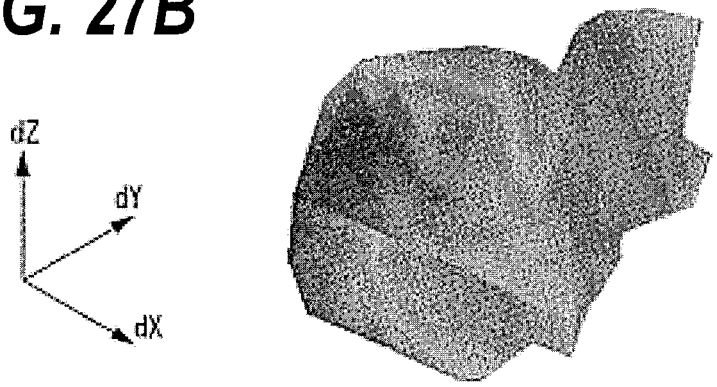
Figure 27C:
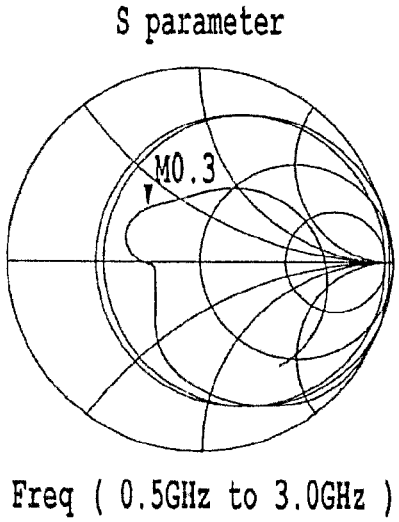
Figure 27D:
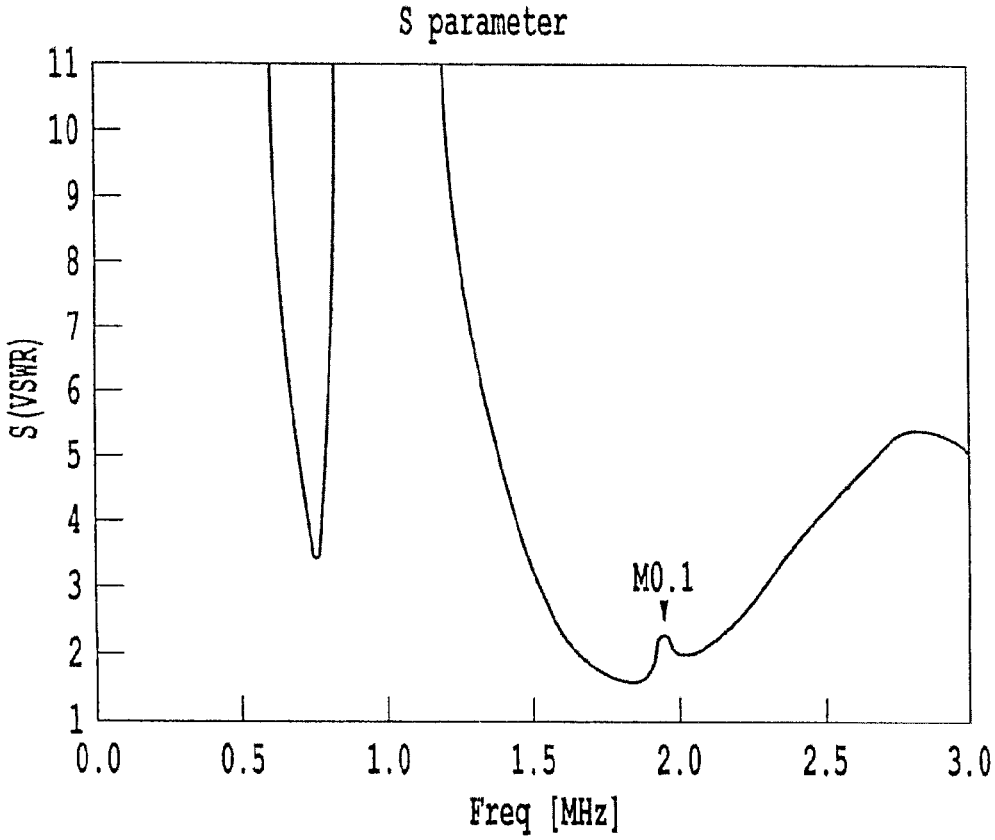

The directivity characteristics of the antenna shown in FIG. 27A are illustrated in FIG. 27B for a case with a frequency of 1.95 GHz. The maximum directivity value in this case is 4.3 dBi. FIGS. 27C and 27D show S parameter (S11) of the antenna in FIG. 27A. In particular, FIG. 27C is a Smith chart which shows the impedance from 0.5 GHz to 3.0 GHz, and FIG. 27D shows VSWR for a corresponding frequency range. As evidenced in comparing FIGS. 26B and 27B, the presence or absence of the component 433 in the antenna's first element may result in large changes in directivity. Moreover, as shown in FIG. 27D, VSWR improves relative to the case of FIG. 26D at the 1.5 GHz resonance frequency vicinity, with values below 4.

Thus, the exemplary illustrations of FIGS. 26A-27D show that the directivity of an antenna can be changed by adding the component 433 to a first element, while providing wide bandwidth properties for the antenna.

Figure 28A:
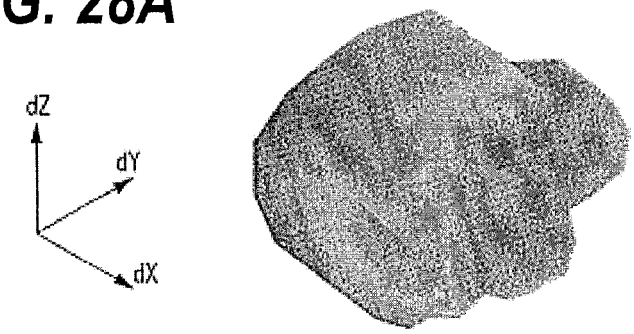
FIGS. 28A-B and 29A-B illustrate directivity characteristics resultant from modifying parameters of the antenna of FIG. 27A.
Figure 28B:
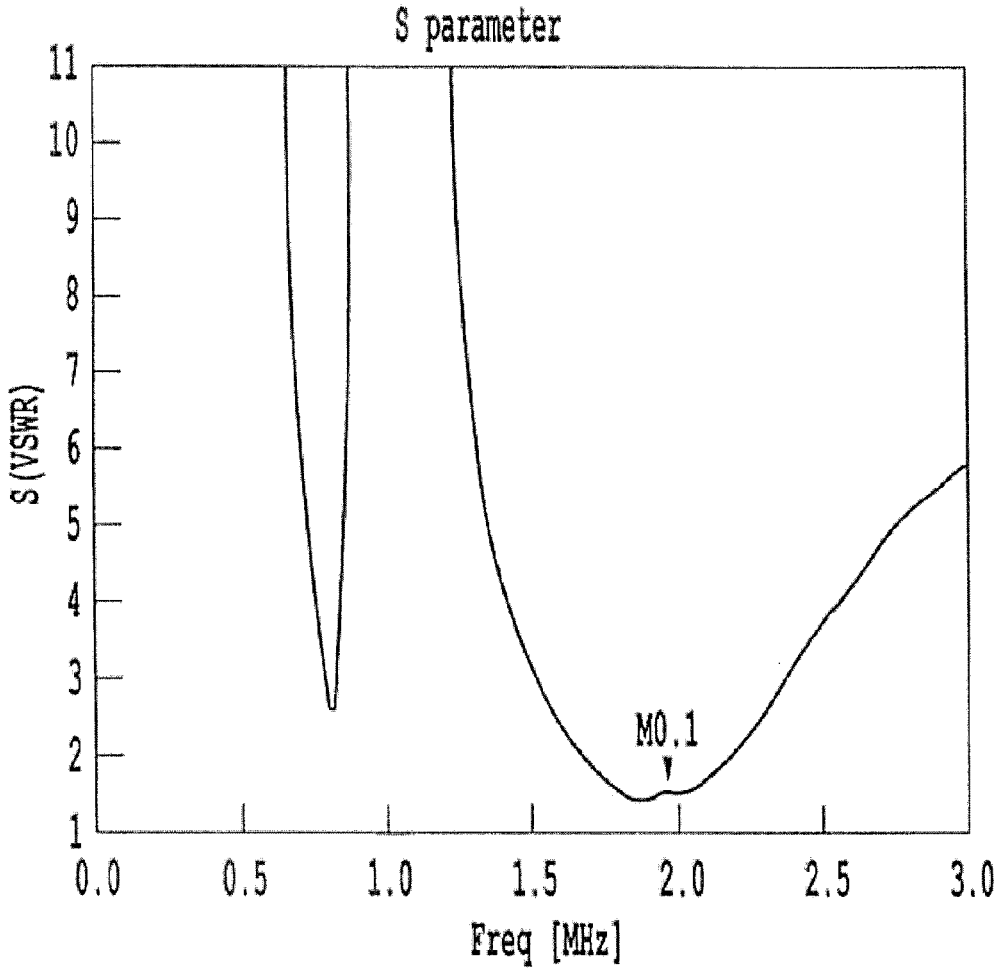

For further illustration purposes, FIGS. 28A and 28B illustrate a second case where the component 433 is included in an antenna's first element, as in FIG. 27A. This second non-limiting example assumes the following parameters:

*La*=19.0 mm

*X*=4.0 mm

*Y*=3.0 mm

*S*=14.0 mm

*Q*=5.0 mm

*W*=2.0 mm

The directivity in this case is shown in FIG. 28A, and FIG. 28B illustrates VSWR for the 0.5 GHz to 3.0 GHz frequency range. A comparison of FIGS. 28B and 27D illustrates the impact of changing the length S of the component 433.

Figure 29A:
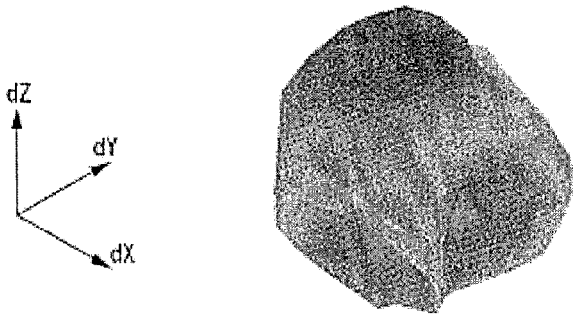
Figure 29B:
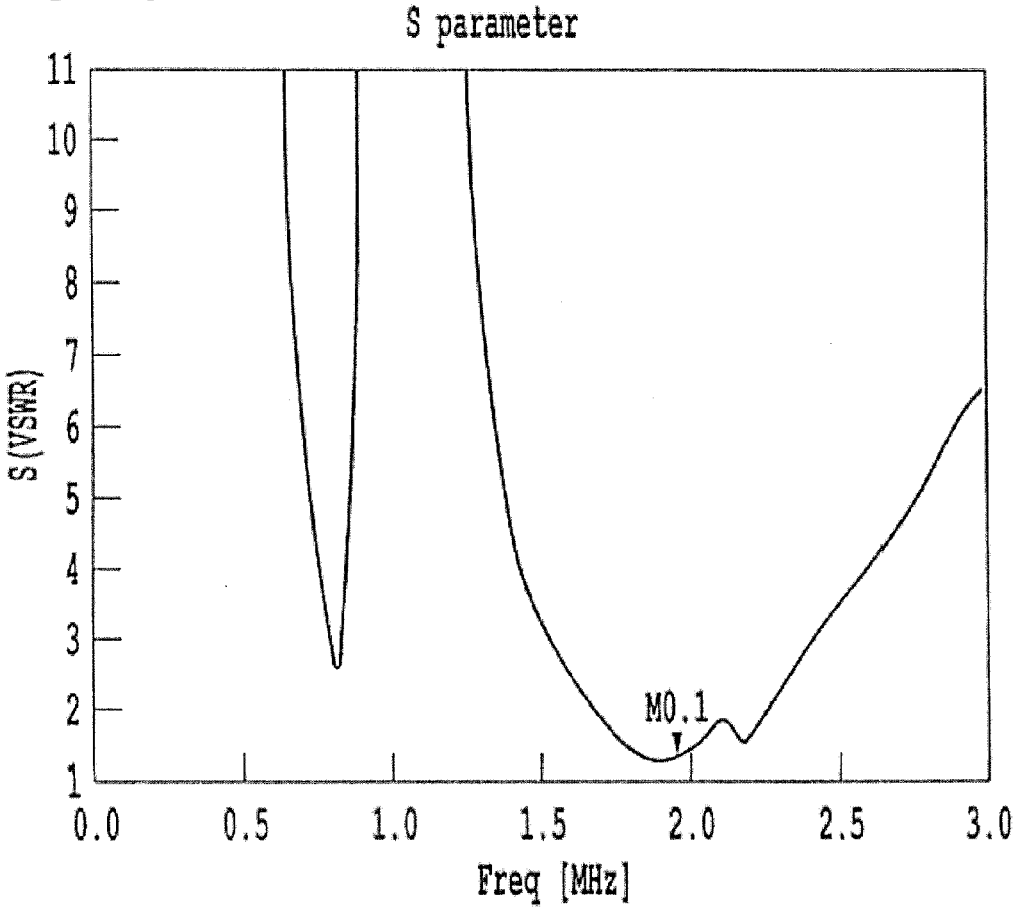

For further illustration purposes, FIGS. 29A and 29B illustrate a third case where the component 433 is included in an antenna's first element, as in FIG. 27A. This third non-limiting example assumes the following parameters:

$La$=19.0 mm $X$=4.0 mm $Y$=3.0 mm $S$=12.0 mm $Q$=6.0 mm $W$=1.0 mm

The directivity in this case is shown in FIG. 28A, and FIG. 28B illustrates VSWR for the 0.5 GHz to 3.0 GHz frequency range. A comparison of FIGS. 29B and 27D illustrates the impact of changing widths Q and W on antenna performance.

Figure 30A:
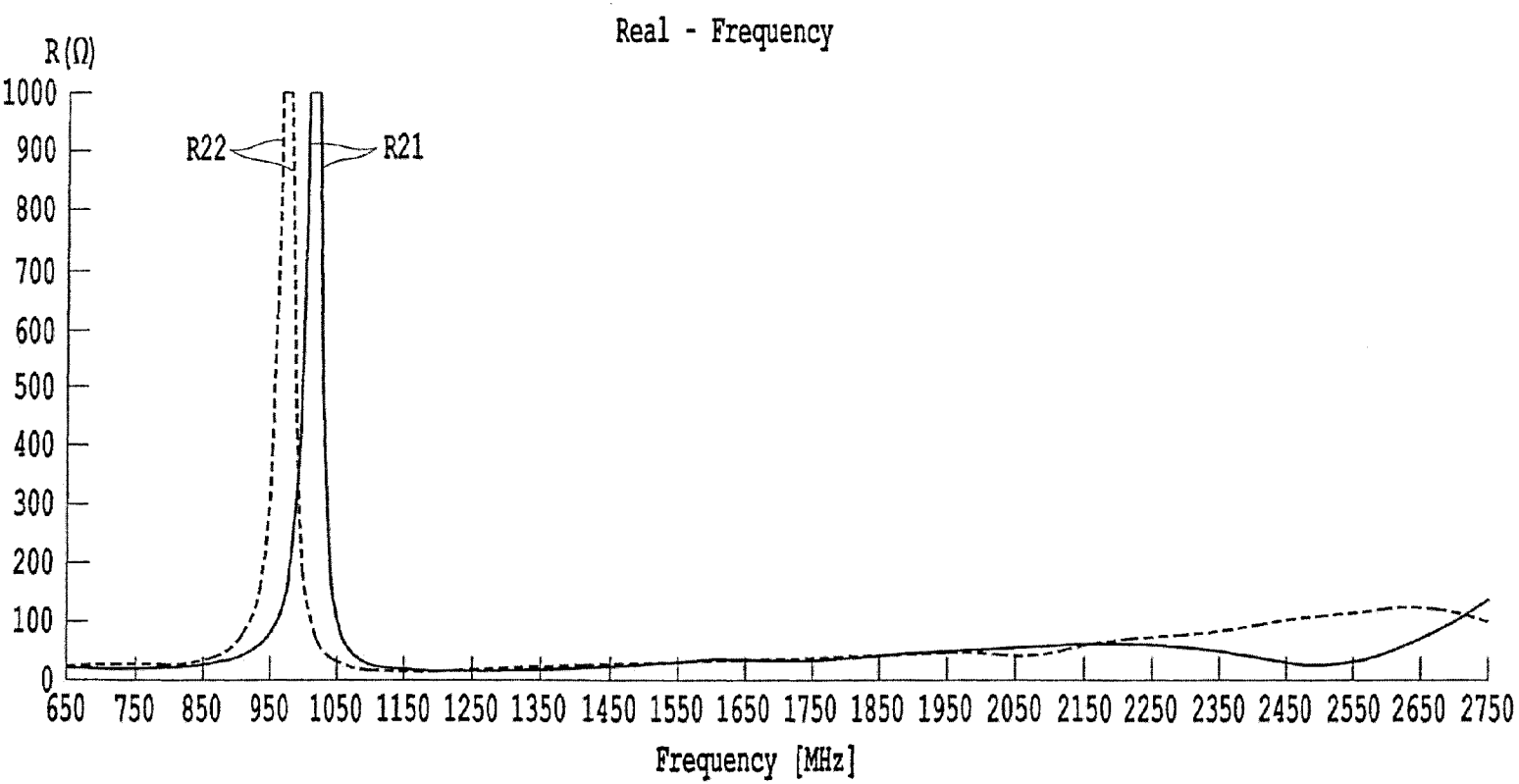
FIGS. 30A and 30B show impedance characteristics for exemplary antennas.
Figure 30B:
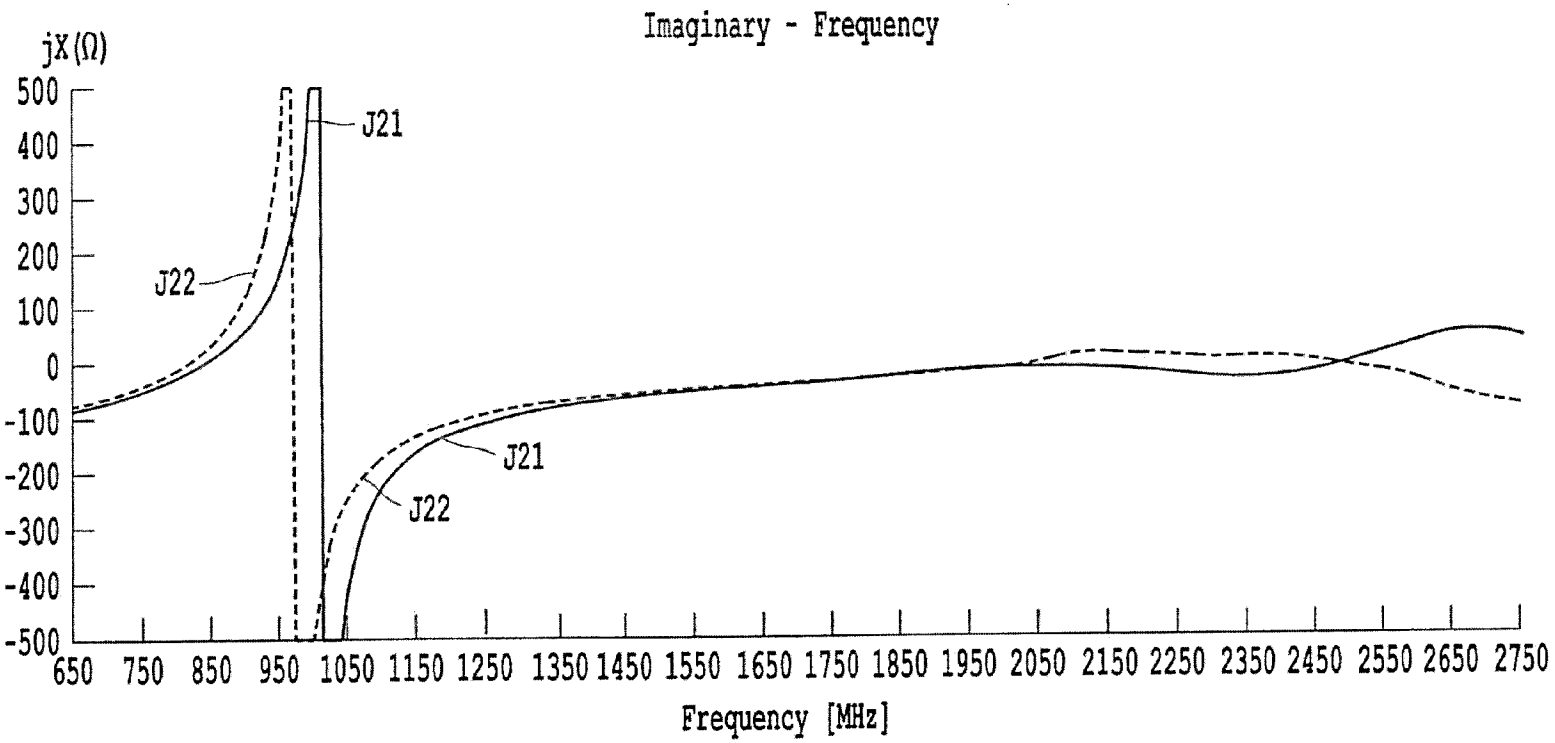

Next, FIGS. 30A and 30B show real and imaginary impedance characteristics (R21 and J21, respectively) of an antenna without the component 433 on the first element (e.g., antenna 30 shown in FIG. 4), and real and imaginary impedance characteristics (R22 and J22, respectively) of an antenna with the component 433 included on the first element, such as in FIG. 23. The parameters of the antenna for this example are as follows:

$La$=21.0 mm $X$=4.0 mm $Y$=3.0 mm $S$=14.0 mm $Q$=5.0 mm $W$=2.0 mm

As shown in the exemplary figures, an antenna without the component 433 exhibits a first anti-resonance frequency at the 1000 MHz vicinity, with a high impedance state continuing to the 1300 MHz vicinity; however, the impedance is comparatively low at 1400 MHz or more. Moreover, reactance becomes zero at a point near the 2500 MHz vicinity.

On the other hand, in the case in which the antenna has the first element 430 with the component 433, together with the second element 32, the first anti-resonance frequency has moved to the 960-MHz vicinity. Although the high impedance state continues to 1300 MHz vicinity in this case, impedance is comparatively low at 1400 MHz or more. Further, the point at which reactance becomes zero moves to the 2040 MHz vicinity. In addition, the change in the real portion other than the first anti-resonance frequency is gentle irrespective of the presence or absence of the component 433. Thus, when the component 433 is present, the frequency $f_c$ at which a reactance component becomes zero is lower relative to the case where the component 433 is not present.

Figure 31:
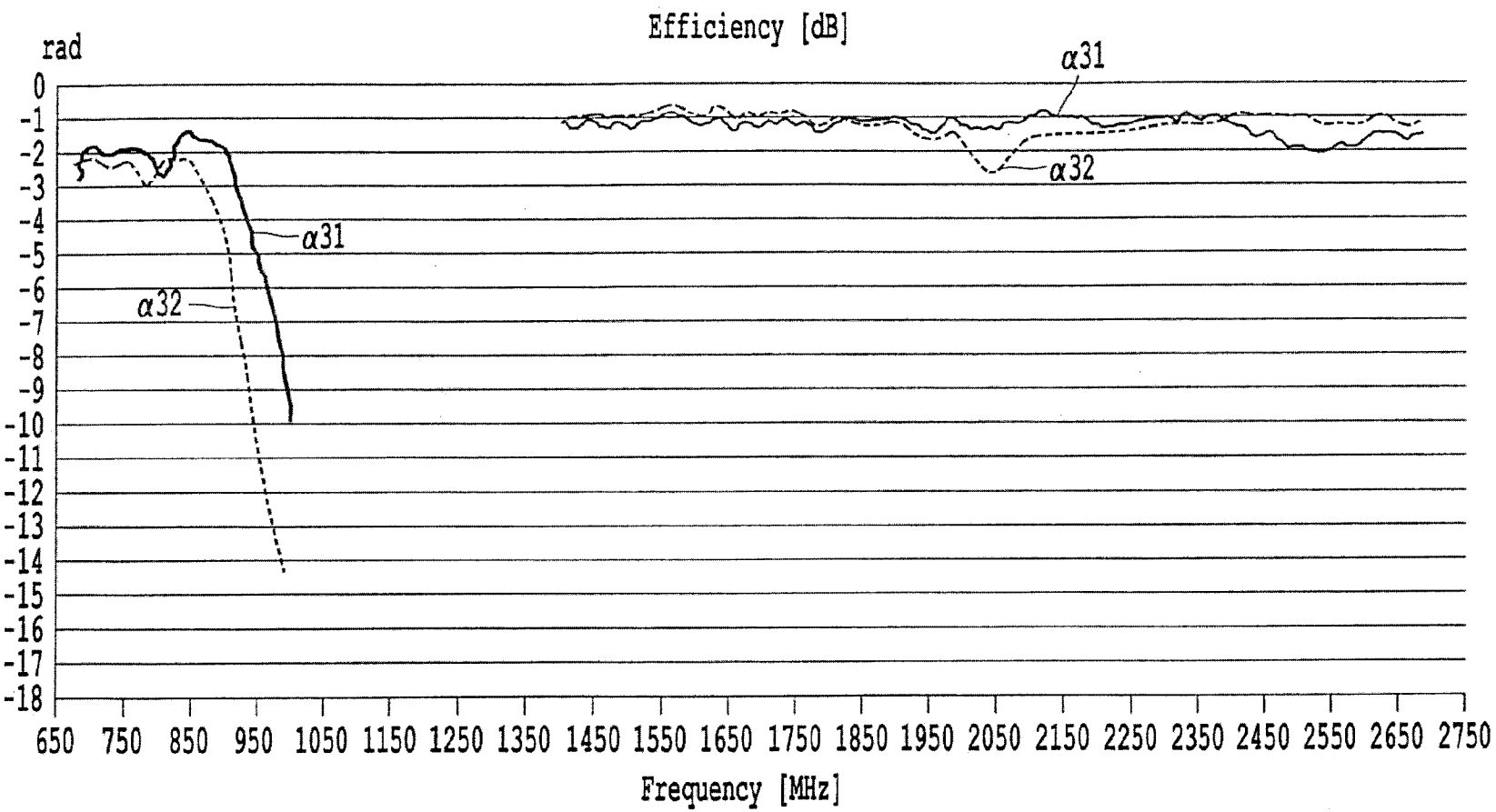
FIG. 31 provides a graph illustrating radiation efficiency for exemplary antennas.

Next, FIG. 31 provides an exemplary graph illustrating radiation efficiency α31 of an antenna without the component 433 (e.g., antenna 30 of FIG. 4), and radiation efficiency α32 of an antenna with the component 433 (e.g., antenna 30 of FIG. 23). FIG. 31 assumes transmission power is supplied to the antennas in a perfect adjustment condition. Referring to the graph, although a decline in radiation efficiency α32 is shown at the 2.05 GHz vicinity, the decrease is small and therefore, this condition is satisfactory. In the low frequency region, although the efficiency at 950 MHz is falling, this can be improved by shortening the length of the first element. Since a fall in efficiency is not seen at the first anti-resonance frequency vicinity, the antenna is operating in a wide bandwidth condition.

Figure 32:
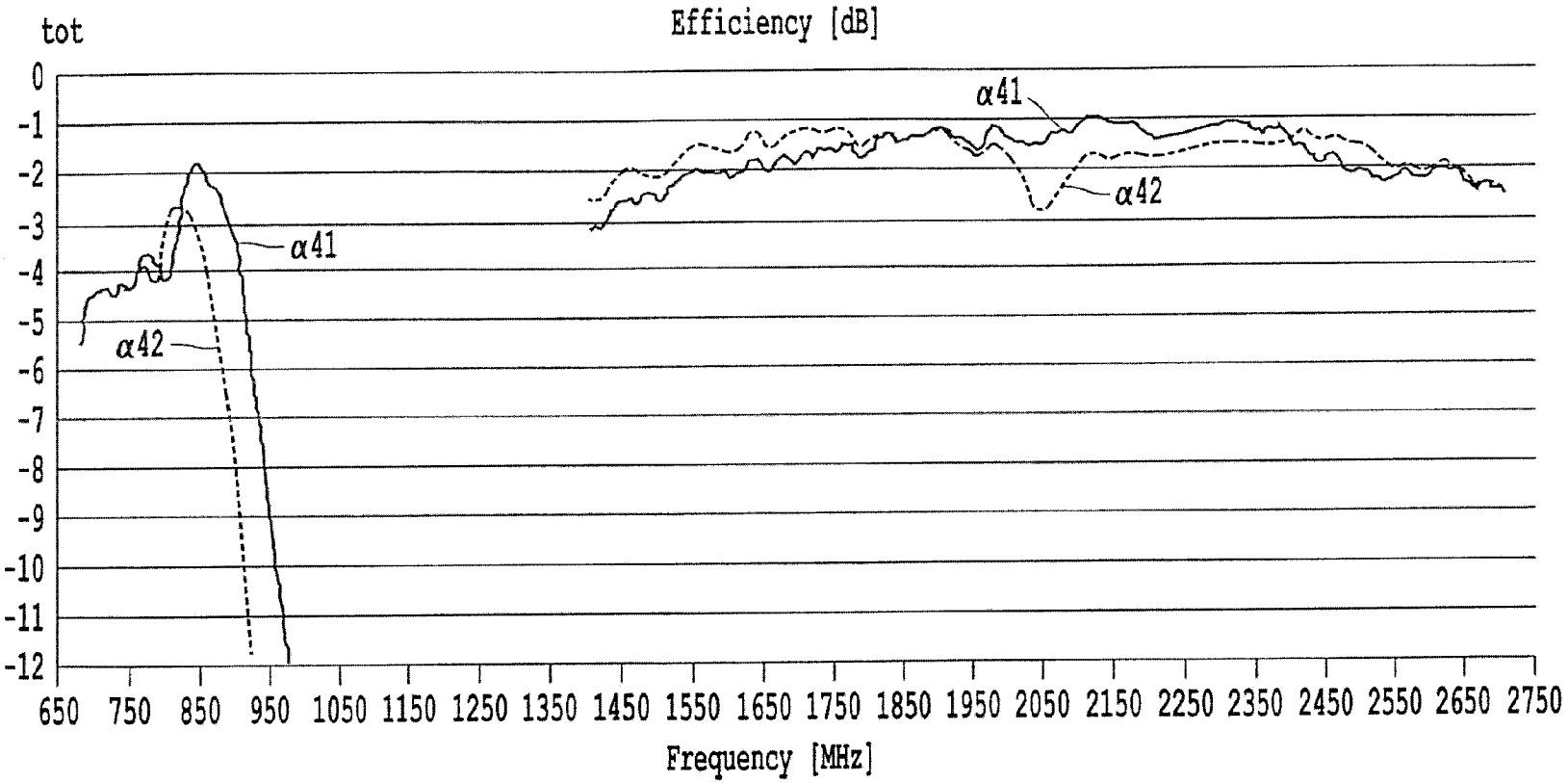
FIG. 32 provides a graph illustrating radiation efficiency of the antennas of FIG. 31 under alternate conditions.

FIG. 32 shows a corresponding radiation efficiency graph as in FIG. 31, but with a normalization impedance of 50 ohms. Under these alternate conditions, FIG. 32 illustrates radiation efficiency α41 of an antenna without the component 433 (e.g., antenna 30 of FIG. 4), and radiation efficiency α42 of an antenna with the component 433 (e.g., antenna 30 of FIG. 23).

Figure 33A:
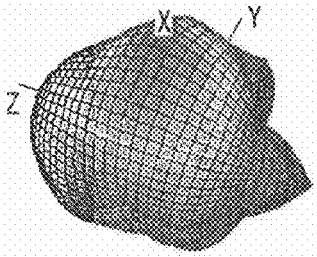
FIGS. 33A-B and 34A-B illustrate directivity for the cases shown in FIGS. 30A and 30B.
Figure 33B:
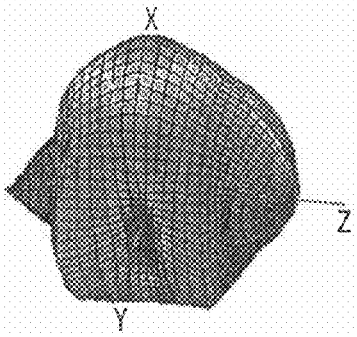
Figure 34A:
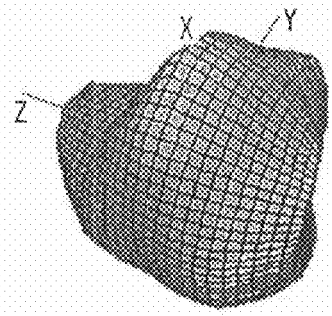
Figure 34B:
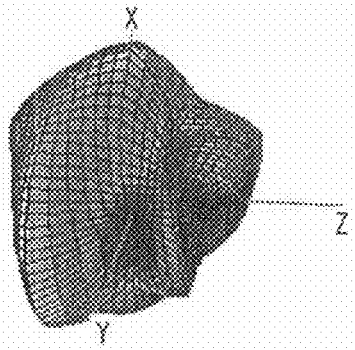

FIGS. 33A-B and 34A-B illustrate directivity for the cases shown in FIGS. 30A and 30B. Specifically, FIGS. 33A and 33B illustrate directivity in the case where no component 433 exists on the first element, and FIGS. 34A and 34B illustrate directivity in the case where the component 433 is included on the first element. FIG. 33B illustrates the graph of FIG. 33A with the Y-axis and Z-axis shifted to the opposite side. Likewise, FIG. 34B illustrates the graph of FIG. 34A with the Y-axis and Z-axis shifted to the opposite side.

Figure 35A:
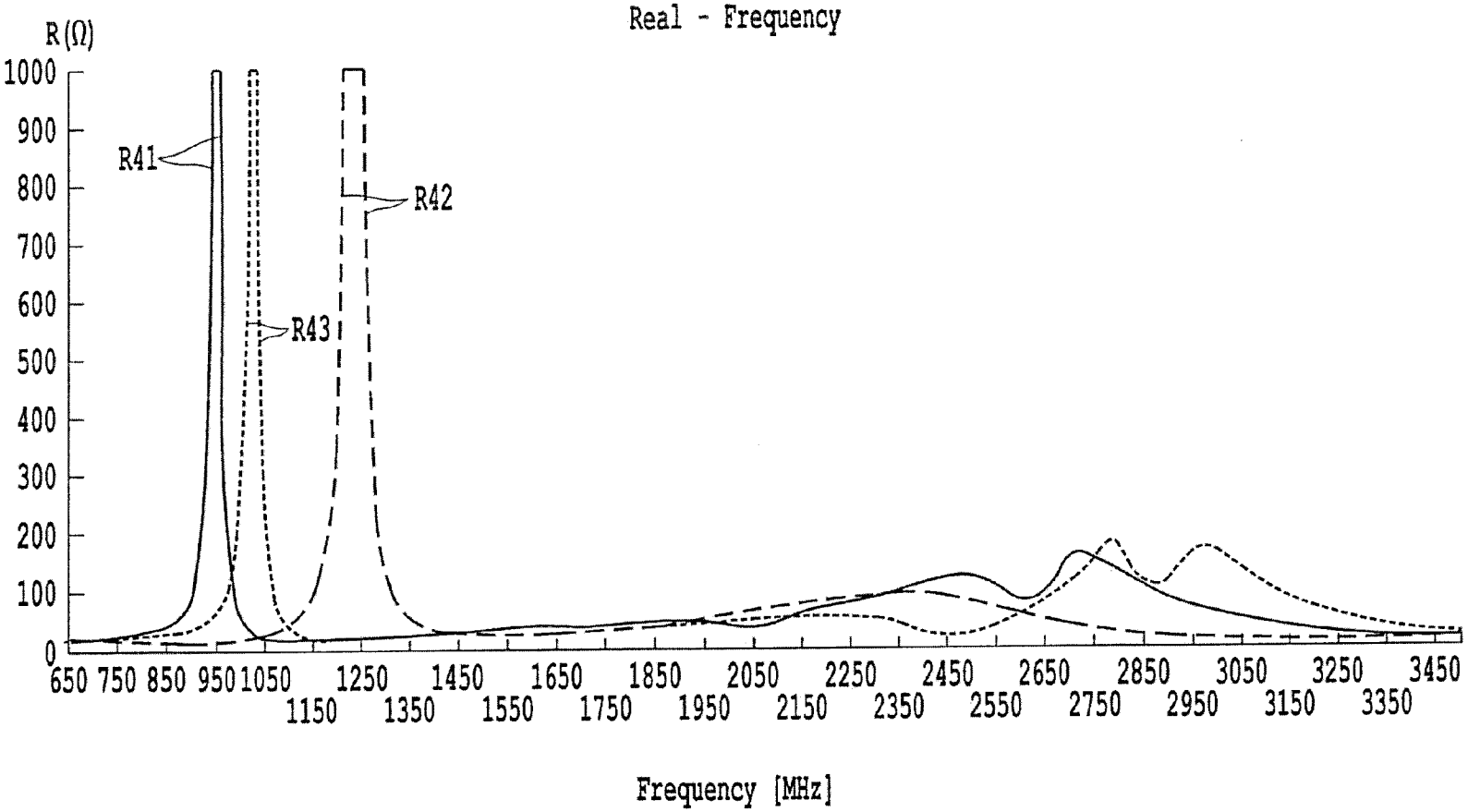
FIGS. 35A and 35B show impedance characteristics for exemplary antennas.
Figure 35B:
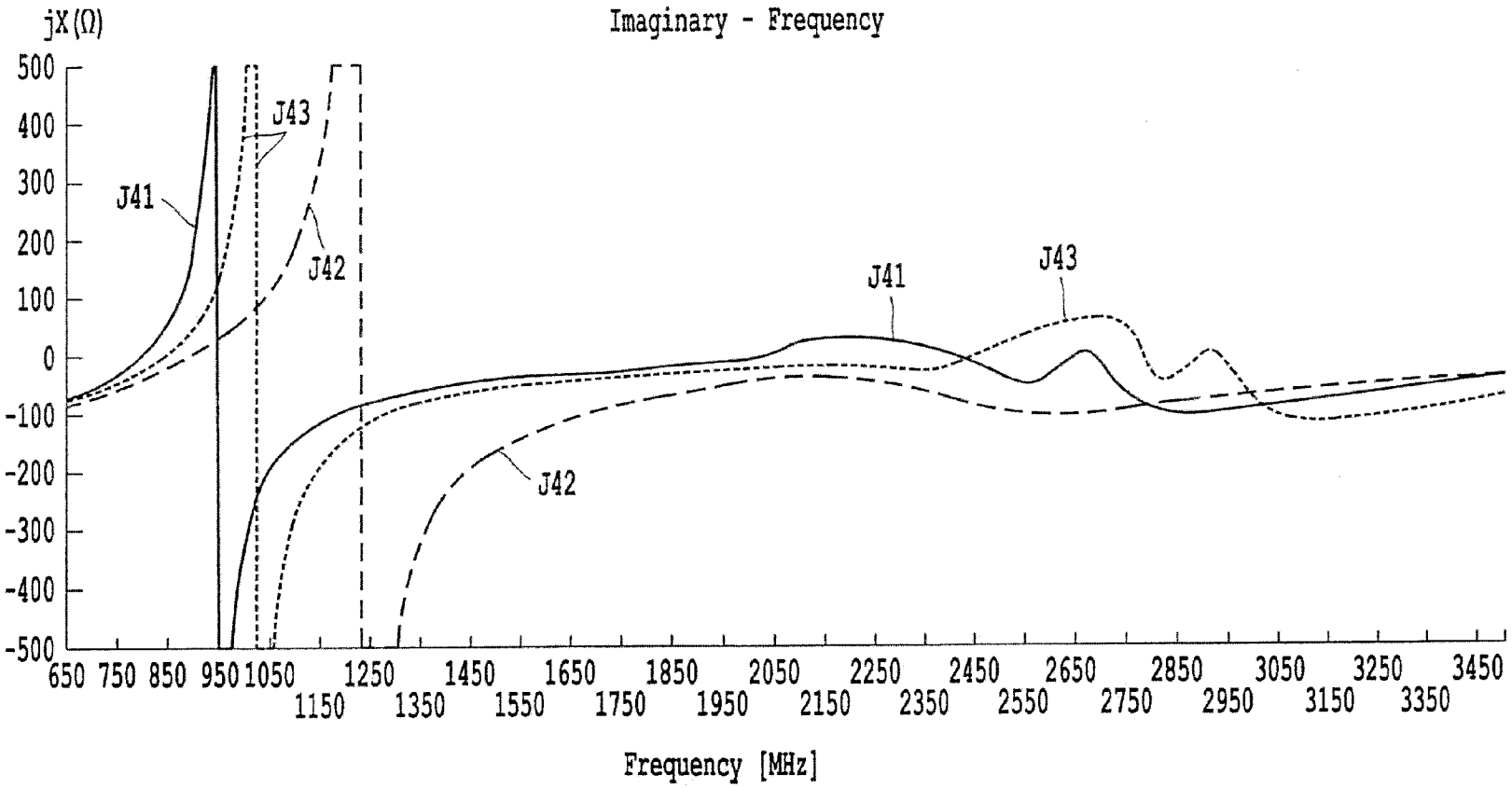

Next, FIGS. 35A and 35B show real and imaginary impedance characteristics (R41 and J41, respectively) of an antenna with a second element and the component 433 included on the first element (e.g., antenna 30 shown in FIG. 4); real and imaginary impedance characteristics (R42 and J42, respectively) of an antenna with a first element including component 433, but no second element; and real and imaginary impedance characteristics (R43 and J43, respectively) of an antenna with a second element and a first element that does not include the component 433. FIG. 35A illustrates the real portion of impedance for each case, and FIG. 35B illustrates the imaginary portion of impedance for each case. In addition, these figures assume the second element is similar to the second element 320 in which components 322 and 323 are extended from component 321 in parallel, such as in FIG. 20L. However, in contrast to FIG. 20L, FIGS. 35A and 35B assume components 322 and 323 are the same length. Moreover, for the case with the antenna of impedance characteristics R41 and J41, the component 433 of the first element 430 is arranged between the components 322 and 323.

Referring to the graphs, there is no frequency at which the reactance component J42 becomes zero for the antenna without a second element. The frequencies at which the reactance component J43 for the antenna without the component 433 becomes zero are 2450 MHz, 2780 MHz, 2880 MHz, and 2930 MHz. The frequencies at which the reactance component J41 for the antenna with the component 433 included becomes zero are 2030 MHz, 2440 MHz, 2630 MHz, 2690 MHz. Thus, as evident in the graphs, the presence and position of the component 433 is shown to change the frequency at which reactance becomes zero.

Figure 36:
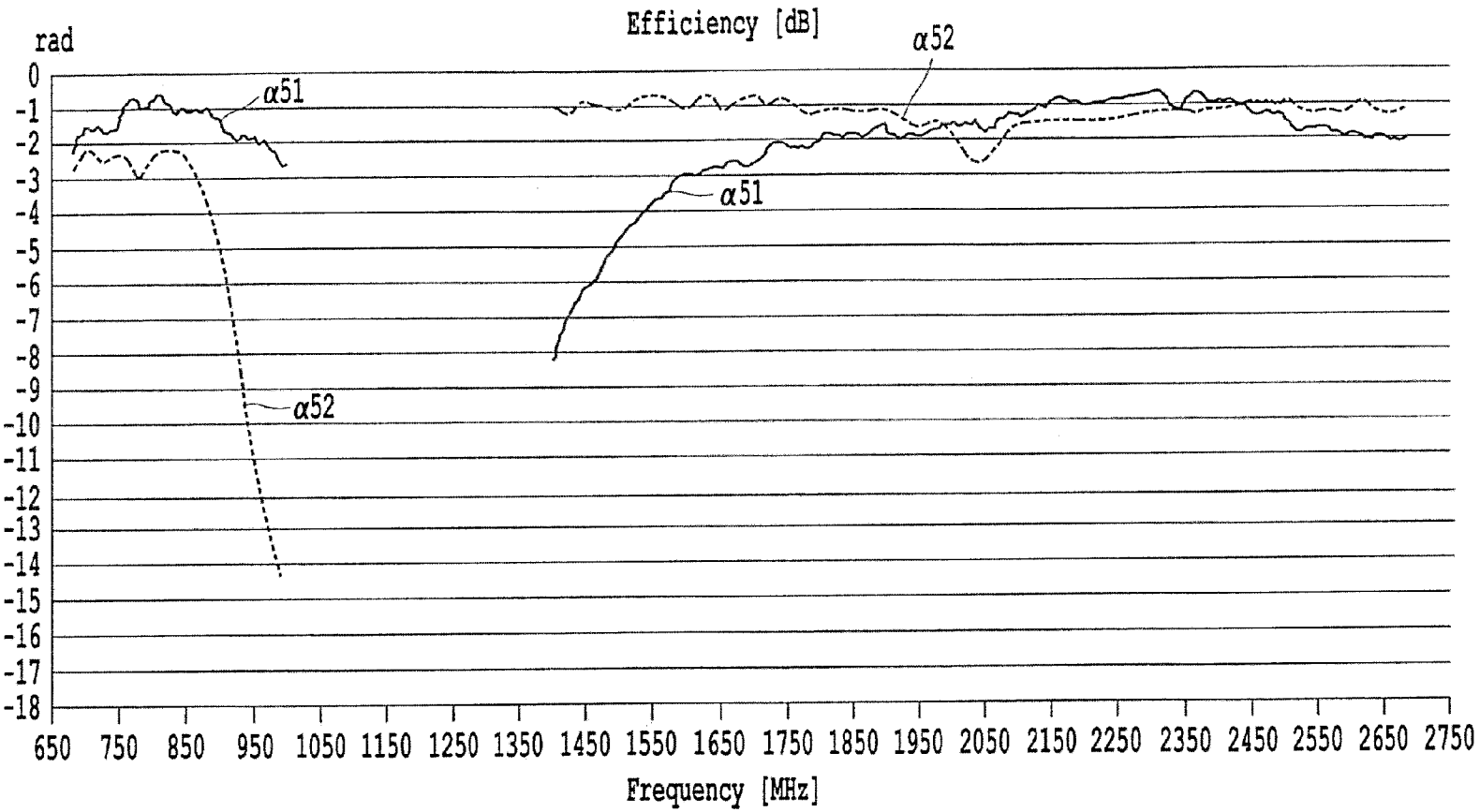
FIG. 36 provides a graph illustrating radiation efficiency for exemplary antennas.

Next, FIG. 36 provides an exemplary graph illustrating radiation efficiency α51 of an antenna without the second element, of the three cases shown in FIGS. 35A and 35B; and radiation efficiency α52 of an antenna with the component 433 included on the first element, of the three cases shown in FIGS. 35A and 35B. Referring to the graphs, although efficiency is shown to decline somewhat at the 2.05 GHz vicinity for α52, the decline is small and therefore, the result is satisfactory. Moreover, in the low frequency region, although the efficiency at 950 MHz is falling, this can be improved by shortening the length of the first element. Since a fall in efficiency is not seen at the first anti-resonance frequency vicinity, the antenna is operating in a wide bandwidth condition.

Figure 37:
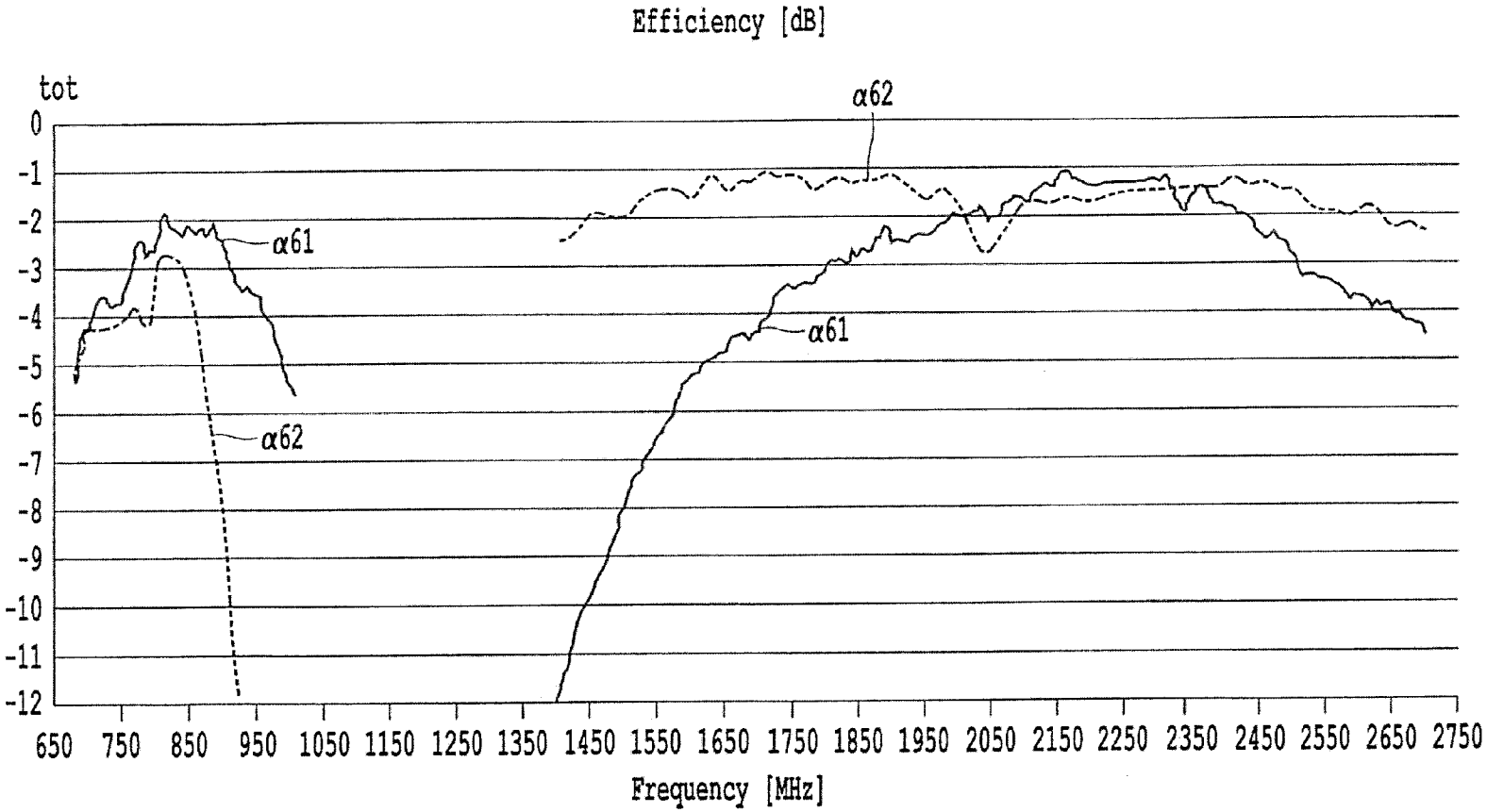
FIG. 37 provides a graph illustrating radiation efficiency of the antennas of FIG. 36 under alternate conditions.

FIG. 37 shows a corresponding radiation efficiency graph as in FIG. 36, but with a normalization impedance of 50 ohms. Under these alternate conditions, FIG. 37 illustrates radiation efficiency α61 of the antenna without the second element, and radiation efficiency α62 of an antenna with the second element and the component 433 included on the first element.

Figure 38A:
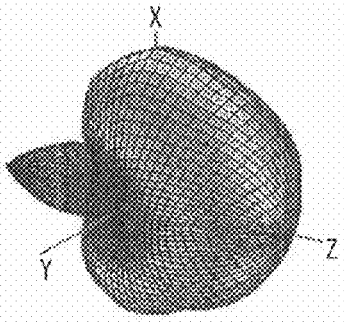
FIGS. 38A-B and 39A-B illustrate directivity for two cases shown in FIGS. 35A and 35B.
Figure 38B:
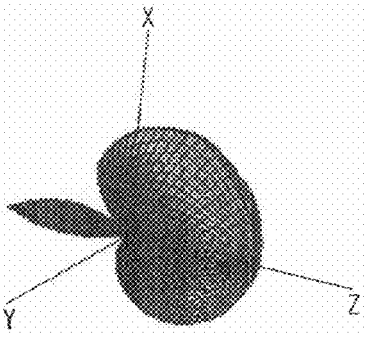
Figure 39A:
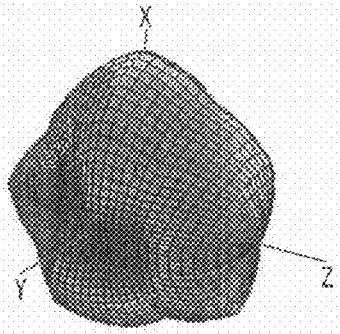
Figure 39B:
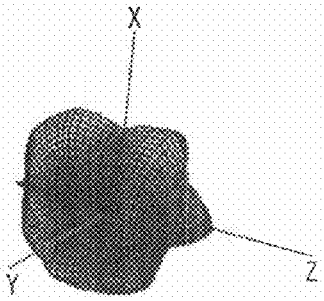

FIGS. 38A-B and 39A-B illustrate directivity for two cases shown in FIGS. 35A and 35B. Specifically, FIGS. 38A and 38B illustrate directivity in the case where the antenna does not include a second element; and FIGS. 39A and 39B illustrate directivity in the case where the antenna includes the second element, and the component 433 is included on the first element. FIGS. 38A and 39A show directivity at 2.15 GHz, and FIGS. 38B and 39B show directivity at 2.55 GHz. Thus, as evidenced by these directivity illustrations, directivity can be changed on the two frequencies based on the presence and location of the second element and the component 433.

Figure 40A:
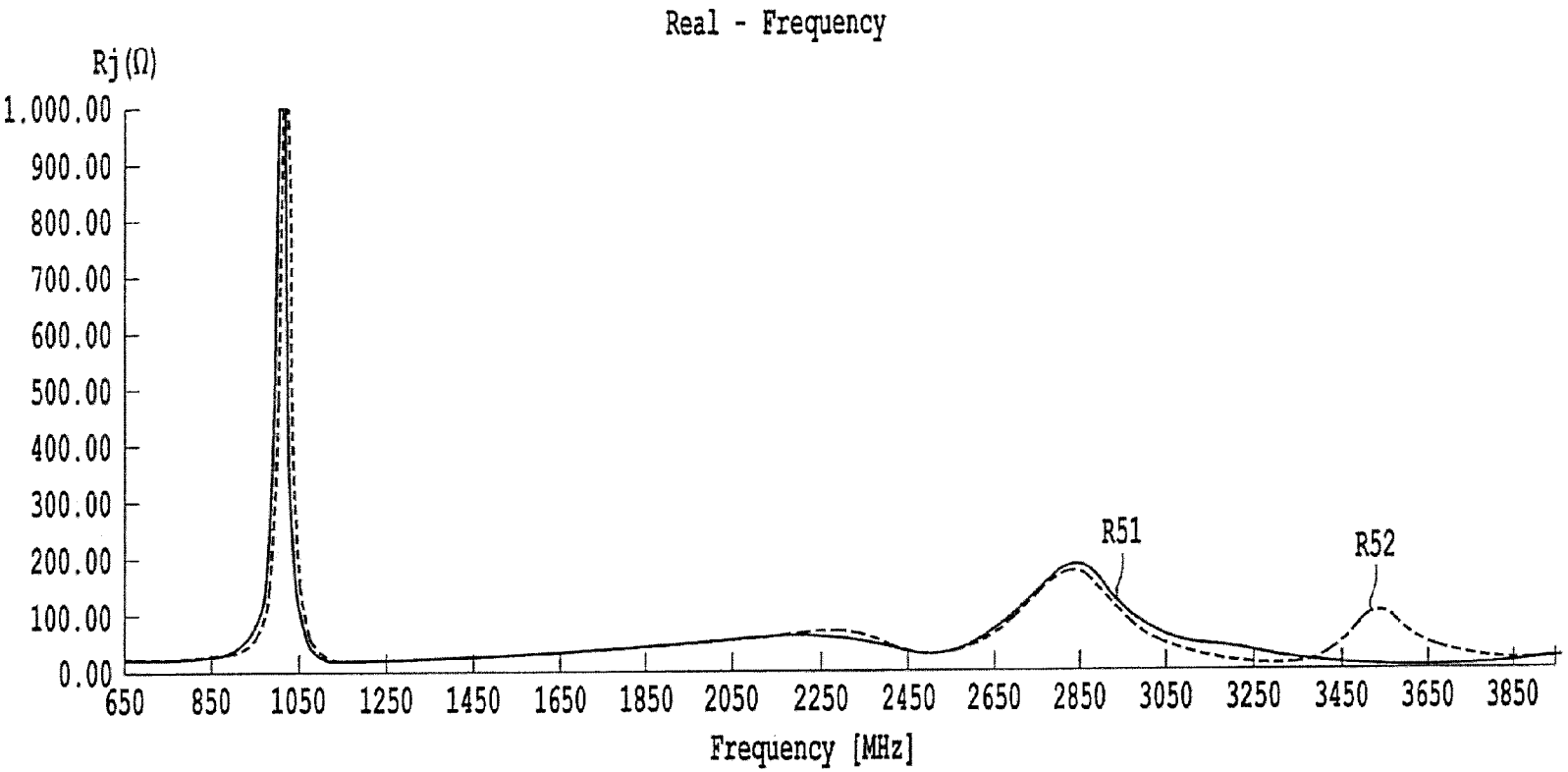
FIGS. 40A and 40B show impedance characteristics for exemplary antennas.
Figure 40B:
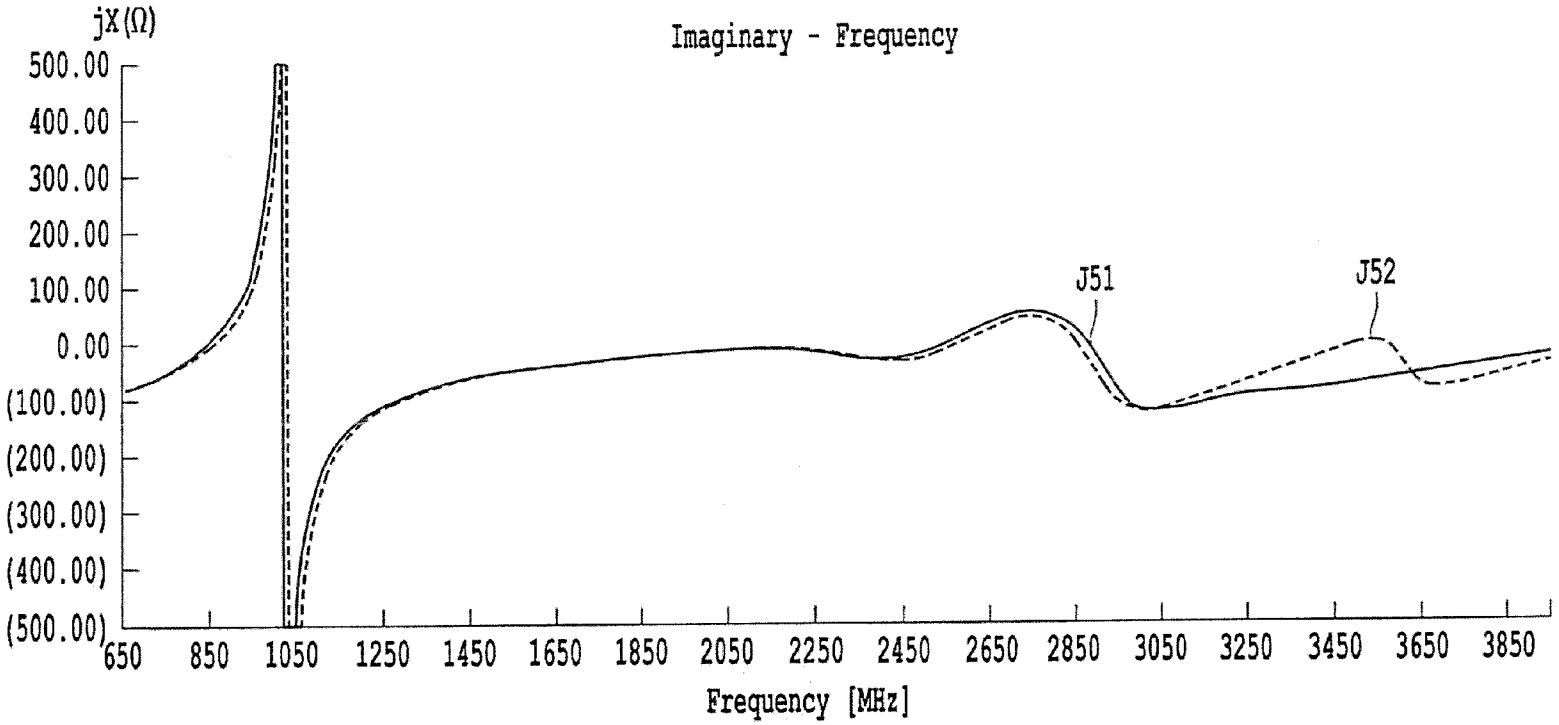

Next, FIGS. 40A and 40B show real and imaginary impedance characteristics of the antenna 30 shown in FIG. 4 (R51 and J51), and the antenna of FIG. 4 modified with the second element 320 shown in FIG. 20L (R52 and J52). In the second exemplary case, the components 322 and 323 are different lengths, as in FIG. 20L, and the component 323 of the second element 320 is assumed to be shorter. Referring to the graphs, the reactance component J51 becomes zero at 2470-2820 MHz, and the reactance component J52 becomes zero at 2470 MHz, 2800 MHz, 3400 MHz, 3500 MHz. That is, the frequency at which the reactance component becomes zero has increased to 2470 MHz under these conditions.

Figure 41A:
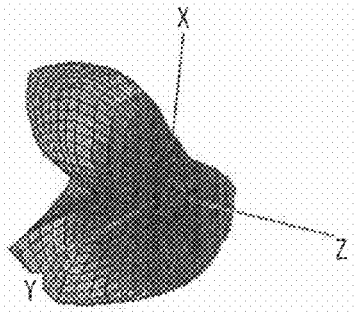
FIGS. 41A-B and 42A-B illustrate directivity for two cases shown in FIGS. 40A and 40B.
Figure 41B:
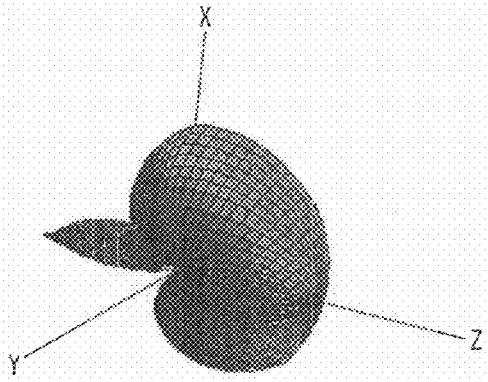
Figure 42A:
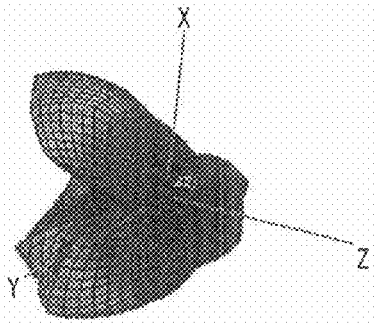
Figure 42B:
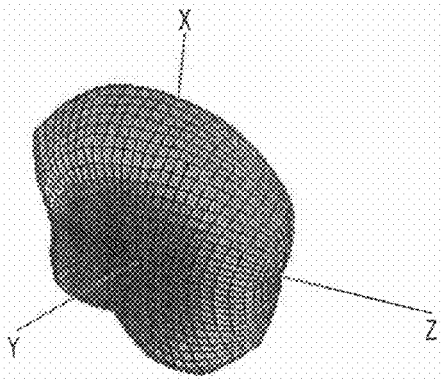

FIGS. 41A-B and 42A-B illustrate directivity for two cases shown in FIGS. 40A and 40B. Specifically, FIGS. 41A and 41B illustrate directivity in the case of antenna 30 from FIG. 4; and FIGS. 42A and 42B illustrate directivity in the case where the antenna 30 is modified by using the second element 320 of FIG. 20L. FIGS. 41A and 42A show directivity at 2.55 GHz, and FIGS. 41B and 42B show directivity at 3.35 GHz. Thus, as evidenced by these directivity illustrations, directivity can be changed on the two frequencies based on the configuration of the second element.

Obviously, numerous modifications and variations of the present disclosure are possible in light of the above teachings. It is therefore to be understood that within the scope of the appended claims, the present disclosure may be practiced otherwise than as specifically described herein. For example, advantageous results may be achieved if components in the present disclosure were combined in a different manner, or if the components were replaced or supplemented by other components. The functions, processes, and algorithms described herein may be performed in hardware or software executed by hardware, including computer processors and/or programmable circuits configured to execute program code and/or computer instructions to execute the functions, processes and algorithms described herein. Additionally, some implementations may be performed on modules or hardware not identical to those described. Accordingly, other implementations are within the scope that may be claimed.

The functions and features described herein may also be executed by various distributed components of a system. For example, one or more processors may execute these system functions, wherein the processors are distributed across multiple components communicating in a network. The distributed components may include one or more client and/or server machines, in addition to various human interface and/or communication devices (e.g., display monitors, smart phones, tablets, personal digital assistants (PDAs)). The network may be a private network, such as a LAN or WAN, or may be a public network, such as the Internet. Input to the system may be received via direct user input and/or received remotely either in real-time or as a batch process.

It must be noted that, as used in the specification and the appended claims, the singular forms "a," "an," and "the" include plural referents unless the context clearly dictates otherwise.

The invention claimed is:

1. An antenna comprising:

a first element extending from a connection point, and having a shape such that a first tip end of the first element extends in a direction toward the connection point; and a second element connected to the connection point, and having a second tip end that extends in a direction away from the connection point, the second tip being disposed within an outer periphery of the first element, wherein the first element includes a first component extending from the connection point, a second component extending from an end of the first component remote from the connection point, and a third component extending from an end of the second component remote from the first component, the first component, the second component, and the third component are arranged such that the first element surrounds the second element on at least three sides, and a distance between a portion of the first element that is parallel to the second element and the second element measured perpendicularly to the portion of the first element and the second element is greater than $\lambda_{gx}/100$, where $\lambda_{gx}$ represents an effective wavelength of a first anti-resonance frequency of the antenna.

2. The antenna of claim 1, wherein a length (L1) of the first element satisfies:

$$5*(2n+1)*\lambda_{g1}/8<L1<7*(2n+1)*\lambda_{g1}/8,$$

where $\lambda_{g1}$ is an effective wavelength corresponding to a minimum frequency of a countermeasure frequency band, and n is an integer ≥0.

3. The antenna of claim 1, wherein a length (L2) of the second element satisfies:

$$L2<=(2n+1)*\lambda_{g1}/4,$$

where $\lambda_{g1}$ is an effective wavelength corresponding to a minimum frequency of a countermeasure frequency band, and n is an integer ≥0.

4. The antenna of claim 1, wherein the first element and the second element are mounted on a circuit board.

5. The antenna of claim 1, further comprising:

a third element that is connected to the connection point, wherein a length of the third element is set such that a Voltage Standing Wave Ratio (VSWR) of the antenna is less than seven.

6. The antenna of claim 1, wherein:

the second element includes a first portion and a second portion that form an L-shape, the second portion including the second tip end, and the second portion of the second element extends within the outer periphery of the first element.

7. The antenna of claim 6, wherein the second portion of the second element includes an opening.

8. The antenna of claim 7, wherein the opening is substantially a same length as the second portion of the second element.

9. The antenna of claim 7, wherein the opening is shorter than the second portion of the second element and is offset from a center of the second portion.

10. The antenna of claim 7, wherein the opening is formed at the second tip end such that the opening bifurcates the second portion of the second element.

11. The antenna of claim 6, wherein the second portion of the second element includes an inclination part corresponding to the second tip end.

12. The antenna of claim 6, wherein the second element includes a third portion extending from the first portion in a direction corresponding to the second portion.

13. The antenna of claim 12, wherein the second portion is longer than the third portion.

14. The antenna of claim 12, wherein the third portion is wider than the second portion.

15. The antenna of claim 6, wherein:

the first element extends from the connection point in a direction corresponding to the second portion.

16. The antenna of claim 6, wherein:

the first element further includes an extension component located at a point on the first element after the shape changes direction, and the extension component extends toward the connection point.

17. The antenna of claim 16, wherein the extension component extends past the second tip of the second element.

18. The antenna of claim 17, wherein the extension component extends between the second portion of the second element and a first portion of the first element that is parallel to the second portion of the second element.

19. The antenna of claim 1, wherein the shape of the first element results in the first tip extending past the connection point.

20. A terminal device comprising:

an antenna including a first element and a second element connected at a connection point, wherein the first element extends from the connection point, and has a shape such that a first tip end of the first element extends in a direction toward the connection point, the second element includes a second tip end extending in a direction away from the connection point, the second tip being disposed within an outer periphery of the first element, the first element includes a first component extending from the connection point, a second component extending from an end of the first component remote from the connection point, and a third component extending from an end of the second component remote from the first component, the first component, the second component, and the third component are arranged such that the first element surrounds the second element on at least three sides, and a distance between a portion of the first element that is parallel to the second element and the second element measured perpendicularly to the portion of the first element and the second element is greater than $\lambda_{g1}/100$, where $\lambda_{gx}$ represents an effective wavelength of a first anti-resonance frequency of the antenna.

21. A circuit board comprising:

a first element and a second element formed on a surface of the circuit board, and connected at a connection point to form an antenna, wherein the first element extends from the connection point along the surface of the circuit board, and has a shape such that a first tip end of the first element extends in a direction toward the connection point, the second element includes a second tip end extending in a direction away from the connection point, the second element being disposed within an outer periphery of the first element, the first element includes a first component extending from the connection point, a second component extending from an end of the first component remote from the connection point, and a third component extending from an end of the second component remote from the first component, the first component, the second component, and the third component are arranged such that the first element surrounds the second element on at least three sides, and a distance between a portion of the first element that is parallel to the second element and the second element measured perpendicularly to the portion of the first element and the second element is set greater than $\lambda_{g1}/100$, where $\lambda_{gx}$ represents an effective wavelength of a first anti-resonance frequency of the antenna.

* * * * *